United States Patent [19]

Suzuki et al.

[11] Patent Number: 4,511,240

[45] Date of Patent: Apr. 16, 1985

[54] ELECTROSTATIC RECORDING APPARATUS

[75] Inventors: Koji Suzuki, Yokohama; Kouki Kuroda; Jyoji Nagahira, both of Tokyo, all of Japan

[73] Assignee: Canon Kabushiki Kaisha, Tokyo, Japan

[21] Appl. No.: 338,045

[22] Filed: Jan. 8, 1982

[30] Foreign Application Priority Data

| | | | |
|---|---|---|---|
| Jan. 13, 1981 | [JP] | Japan | 56-2637 |
| Jan. 13, 1981 | [JP] | Japan | 56-2638 |
| Jan. 13, 1981 | [JP] | Japan | 56-2639 |
| Jan. 13, 1981 | [JP] | Japan | 56-2640 |
| Jan. 13, 1981 | [JP] | Japan | 56-2641 |
| Jan. 13, 1981 | [JP] | Japan | 56-2643 |
| Jan. 14, 1981 | [JP] | Japan | 56-3253 |
| Jan. 14, 1981 | [JP] | Japan | 56-3254 |
| Jan. 14, 1981 | [JP] | Japan | 56-3255 |
| Jan. 14, 1981 | [JP] | Japan | 56-3256 |
| Jan. 14, 1981 | [JP] | Japan | 56-3257 |
| Jan. 14, 1981 | [JP] | Japan | 56-3258 |
| Jan. 14, 1981 | [JP] | Japan | 56-3259 |

[51] Int. Cl.[3] ..... G03G 15/00

[52] U.S. Cl. ..... 355/14 R; 355/14 E

[58] Field of Search ..... 355/14 E, 14 CH, 55, 355/56, 3 R, 14 R

[56] References Cited

U.S. PATENT DOCUMENTS

| | | | |
|---|---|---|---|
| 4,215,930 | 8/1980 | Miyakawa et al. | 355/14 E X |
| 4,268,165 | 5/1981 | Bradmon | 355/55 |
| 4,277,162 | 7/1981 | Kasahara et al. | 355/14 R |
| 4,279,498 | 7/1981 | Eda et al. | 355/14 E X |
| 4,348,099 | 9/1982 | Fantozzi | 355/14 E |
| 4,372,672 | 2/1983 | Pries | 355/14 R |
| 4,372,676 | 2/1983 | Miyata et al. | 355/55 X |
| 4,390,266 | 6/1983 | Uchida | 355/14 E |

*Primary Examiner*—A. C. Prescott

*Attorney, Agent, or Firm*—Fitzpatrick, Cella, Harper & Scinto

[57] ABSTRACT

An electrostatic recording apparatus has a sensor for detecting a surface potential of a photosensitive member on which an electrostatic latent image is formed and a controller for controlling a developing bias voltage in accordance with the detected surface potential. The developing bias voltage includes an A.C. component and a D.C. component which are selectively used in accordance with a latent image potential. The frequency of the A.C. developing bias and the magnitude of the D.C. developing bias are variable so that an optimum quality of image is reproduced.

11 Claims, 27 Drawing Figures

| | |
|---|---|
| FIG. 2A | FIG. 2B |
| FIG. 2C | FIG. 2D |

FIG. 2

| | |
|---|---|
| FIG. 3A | FIG. 3B |
| FIG. 3C | FIG. 3D |

FIG. 3

| |
|---|
| FIG. 4B-1 |
| FIG. 4B-2 |

FIG. 4B

| | |
|---|---|
| FIG. 5A | FIG. 5B |
| FIG. 5C | FIG. 5D |

FIG. 5

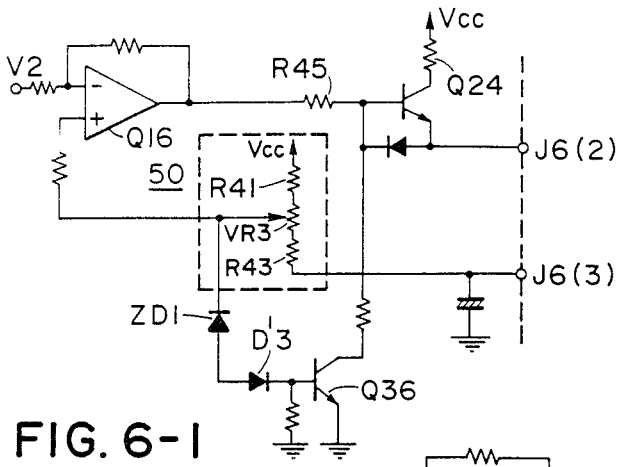
FIG. 6-1
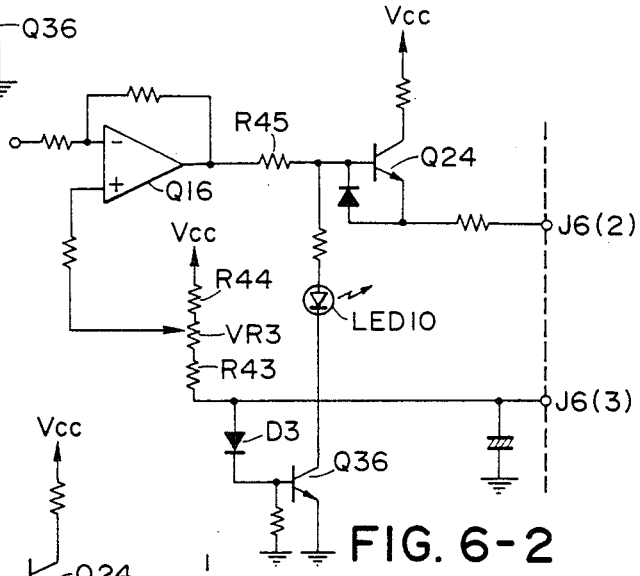
FIG. 6-2
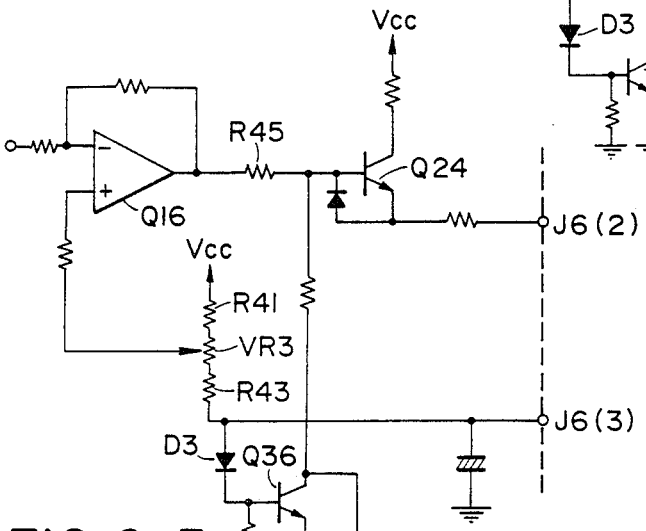
FIG. 6-3
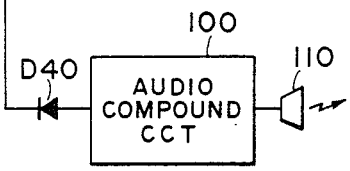

ELECTROSTATIC RECORDING APPARATUS

BACKGROUND OF THE INVENTION

1. Field of the Invention

The present invention relates to a developing bias device of an electrostatic recording apparatus, and more particularly to an electrostatic recording apparatus for developing an electrostatic latent image formed on a record medium (e.g. a photosensitive drum) through charging and light exposing steps, with toner.

2. Description of the Prior Art

In a conventional electrostatic recording apparatus of this type, the amount of charge, the amount of light exposure or the amount of developing bias is controlled by a digital computer based on a surface potential measured so that an optimum quality of image is recorded. In such a control, if a blank exposure lamp is not lit or a potential measuring circuit is in failure, an abnormal voltage measured is applied to the computer as a potential data. If the abnormal voltage is processed, the amount of charge, the amount of light exposure or the amount of developing bias is too abnormal to carry out normal recording of image.

A D/A converter is usually used to convert the output from the digital computer to analog values. As the LSI technology develops, D/A converter chips having various types of functions are available. For example, a certain D/A converter LSI chip has four circuits which produce pulse outputs having resolutions of 12 bits, 6 bits, 4 bits and 4 bits, respectively and have duty factors proportional to input data, and 8-bit expansion output ports.

When such a chip is used, the image forming conditions such as the amount of primary charge, the amount of secondary charge, the amount of light exposure and the amount of developing bias can be controlled by a single D/A converter LSI chip and hence it is very advantageous from the viewpoints of space factor and cost.

On the other hand, in spite of the advantage of multi-output, the resolution is restricted. Accordingly, when a four-bit output is used to control the amount of developing bias, the resolution is short. Although it may be relieved by using other high order bits, another control factor (for example, primary or secondary charge) is sacrificed. Since it is desired to control the amount of primary charge and the amount of secondary discharge with rather high precision, 12 bits or 6 bits are used therefor. The amount of light exposure may be controlled by four bits because a control range is not wide and the control may be repeated several times. Regarding the amount of developing bias, if a control range of −200 V to 400 V D.C. developing bias is selected, the resolution is approximately 38 V/bit for the 4-bit output. This resolution is too coarse for the amount of developing bias to attain a sufficient function for intended stability of image.

When a micro-computer is used to digitally control the latent image forming conditions, a digital computer (control unit) which stores a program for sequence controlling the latent image formation and a digital computer (control unit) which stores a program for controlling the latent image forming conditions or the developing conditions are used with data being exchanged therebetween. However, if a failure such as break in a connector or a cable in a data line between the units occurs, a malfunction due to the abnormal data is not detected or the malfunction is not corrected so that proper image is not formed.

An electrostatic recording apparatus has been proposed in which a surface potential is measured by a potential sensor and a potential measuring circuit and the surface potential measured is A/D converted to control the image forming conditions such as charge and developing bias by processing it by a microcomputer. In such a system, the potential sensor and the potential measuring circuit are controlled in union with a gain of the measuring circuit being variable. Accordingly, when the potential sensor and the potential measuring circuit are replaced in union, only level adjustment of an A/D converter section is needed. They are connected to the microcomputer such that when a potential of zero volt is applied to the potential sensor the microcomputer produces a data corresponding to zero volt For example, the level of the A/D converter is adjusted while monitoring 8-column LED cells which indicate 8-bit data. If, by some reason or other, a failure occurs in the potential sensor or the potential measuring circuit, the potential measuring circuit and the A/D converter circuit may be isolated from each other, as an tentative measure, to operate the apparatus only with the circuits including the A/D converter and succeeding stages. In this case, it is desirable by the following reasons that the A/D converted input is set to the same level as that defined by the zero volt of the potential sensor.

1. Readjustment of the level of the A/D converter circuit is easy to attain.
2. By checking the result of the control operation which is carried out under the assumption that the surface potential of zero volt was measured, the operation of the combination of the A/D converter, the microcomputer, the D/A converter and the controller can be diagnosed. (The control operation by the zero volt measurement relates to the control for the amount of light exposure and the amount of developing bias.

If a surface potential of a photosensitive member is zero volt at irradiation by a standard white plate, the micro-computer produces a standard value without requiring any decision on a control voltage because a target voltage is zero volt. The fact that the potential for determining the developing bias is zero volt means that +100 V, for example, of developing bias is produced.)

In the prior art apparatus, however, since the measuring circuit has an output impedance of 100 KΩ, if the zero volt is directly applied to the A/D converter input after the measuring circuit and the A/D converter circuit have been isolated from each other, a voltage which exactly corresponds to the zero volt input is not A/D converted and the indication does not show a predetermined value. Accordingly, it is necessary to connect a resistor of 100 KΩ (of 1% grade) corresponding to the output impedance between the A/D converter input and ground by means of clip or the like. The tentative operation of the apparatus under such a condition is unstable.

In such an electrostatic recording apparatus, a fog appears in the reproduced image or the density of the image is reduced depending on the condition of the photoconductor or the photoconductive drum and hence an image of proper density cannot be reproduced.

This will be explained below with reference to FIGS. 11 and 12.

FIG. 11 shows characteristic curves illustrating a relationship between a surface potential of a photoconductive drum and an exposure quantity. A curve (A) shows a characteristic at room temperature and room humidity, a curve (B) shows a characteristic at high humidity and a curve (C) shows a characteristic after aging test.

The quality of image adjusted under the characteristic (A) is apt to produce fog in the characteristic (B) and is apt to reduce the density in the characteristic (C). If a user wants to adjust the quality, he or she must operate an image quality selection switch which is linked to an exposure quantity dial or developing bias. Since this adjustment usually needs the adjustment of charge quantity, it is not possible for the user to adjust.

FIG. 12 shows characteristic curves illustrating a relationship between a potential and an exposure quantity when a charge voltage is controlled by dark and bright area potentials measured. The characteristics (A), (B) and (C) correspond to those of FIG. 1. While the potential control in FIG. 12 is intended to overcome the shortcoming encountered in FIG. 11, there still remain differences between the characteristic (A) and the characteristics (B) and (C). In order to prevent the fog due to the difference in the characteristics, it has been proposed to measure a white background potential to control the developing bias. However, in this developing bias control system, the image density is reduced by the following reason. In the characteristic (A) of FIG. 12, it is assumed that a potential on a photoconductor is a when a standard plate located beyond an image area is irradiated by a standard exposure quantity ES and a developing bias controlled with reference to the potential a is applied to a developing electrode to reproduce a proper quality of image. When the characteristic changes from (A) to (B), the potential under the standard exposure quantity rises to b. Since the developing bias is controlled with reference to the potential b, a difference between a dark area surface potential ($E_D$ in FIG. 2) and the developing bias potential is reduced. As a result, the fog is eliminated but the density is reduced. In the characteristic (C), the potential falls to c and the developing bias is controlled with reference to the potential c. As a result, a difference between the dark area surface potential and the developing bias potential is larger than that for the characteristic (A) and a higher density of image is reproduced.

In order to compensate for the difference in the density, the standard exposure quantity Es has to be changed in accordance with the status of the photoconductor, such as Es' for the characteristic (B) and Es'' for the characteristic (C) in order to maintain the potential under the standard exposure quantity at a constant level. However, it is troublesome to carry out it manually.

In a one-component toner developing process in which a carrierless toner is used to develop the image, a jumping development process (e.g. refer to Japanese published unexamined patent application No. 55-18656) is used to attain uniform charging of toner and toned development. However, in such a one-component toner jumping development process, because of a large distance between a photoconductive drum and a developing sleeve, a characteristic curve for the photoconductive drum potential and the developed density exhibits a sharp rise as shown by a solid line (A) in FIG. 9 resulting in a low tone image. Accordingly, a high A.C. electric field is applied to the developing sleeve to reciprocate the toner between the drum and the sleeve in order to smoothen the characteristic as shown by a broken line in FIG. 9 to attain a high tone developed image. The A.C. bias applied to the developing roll must have a very small waveform distortion at a frequency of 200~1500 Hz and an amplitude of 600~200 V P—P. In a conventional apparatus, a square wave generated by a multivibrator or a blocking oscillator is used to drive a transformer and an LC resonance circuit is formed by a secondary inductance of the transformer or another choke transformer to produce a sinusoidal wave of a desired frequency. As a result, a large electric power is consumed in the resonance circuit and a large exciting current to the tarnsformer is required. As a result, a vibration noise is produced and adjustment for resonance is required. In order to vary the frequency, a large inductance or capacitance must be varied. Such adjustment is practically difficult to attain.

In a charger for charging the photoconductive drum in such a recording apparatus, a high voltage corona voltage is controlled by a closed loop constant current control system using a high gain differential amplifier. Since a high voltage transformer and a constant current control circuit in high voltage generating means are usually connected via a connector, if a feedback loop to the differential amplifier is opened by an incomplete connection of the connector, a break is a wire or a misconnection, an input in the feedback loop rises close to a power supply voltage and the high voltage transformer produces an abnormally high voltage. As a result, an abnormal corona discharge occurs resulting in leakage, deterioration or break of the photoconductor and break of peripheral circuits of the high voltage transformer. While such accidents may be prevented when the high voltage transformer has an output limiting function, the open loop condition may not be noticed in that case and the operation may be continued while an excessive charge is maintained in the drum.

SUMMARY OF THE INVENTION

It is an object of the present invention to provide an electrostatic recording apparatus capable of reproducing a proper quality of image.

It is another object of the present invention to provide an electrostatic recording apparatus in which a frequency of an A.C. voltage of a developing bias is varied in accordance with a quality of a text image.

It is a further object of the present invention to provide an electrostatic recording apparatus in which a D.C. voltage of a developing bias is varied in accordance with a quality of a text image.

It is a still further object of the present invention to provide an electrostatic recording apparatus in which an exposure quantity is determined in accordance with a detected surface potential of a photoconductor and a developing bias is controlled in accordance with a surface potential of an area to which the determined exposure quantity is irradiated.

It is a further object of the present invention to provide an electrostatic recording apparatus which can enhance a resolution power of a D/A converter which converts an output from a digital computer to an analog quantity.

It is a still further object of the present invention to provide a high voltage corona generator which prevents a high voltage output when a feedback loop for maintaining a high voltage corona output at a constant level fails.

above and other objects of the present invention will be apparent from the following description of the preferred embodiments of the present invention.

BRIEF DESCRIPTION OF THE DRAWINGS

FIGS. 6-1, 6-2 and 6-3 show protection circuits for a high voltage corona generator.

DETAILED DESCRIPTION OF THE PREFERRED EMBODIMENTS

Referring now to FIGS. 1 to 5, one embodiment of the present invention is explained in detail.

Figure 1:
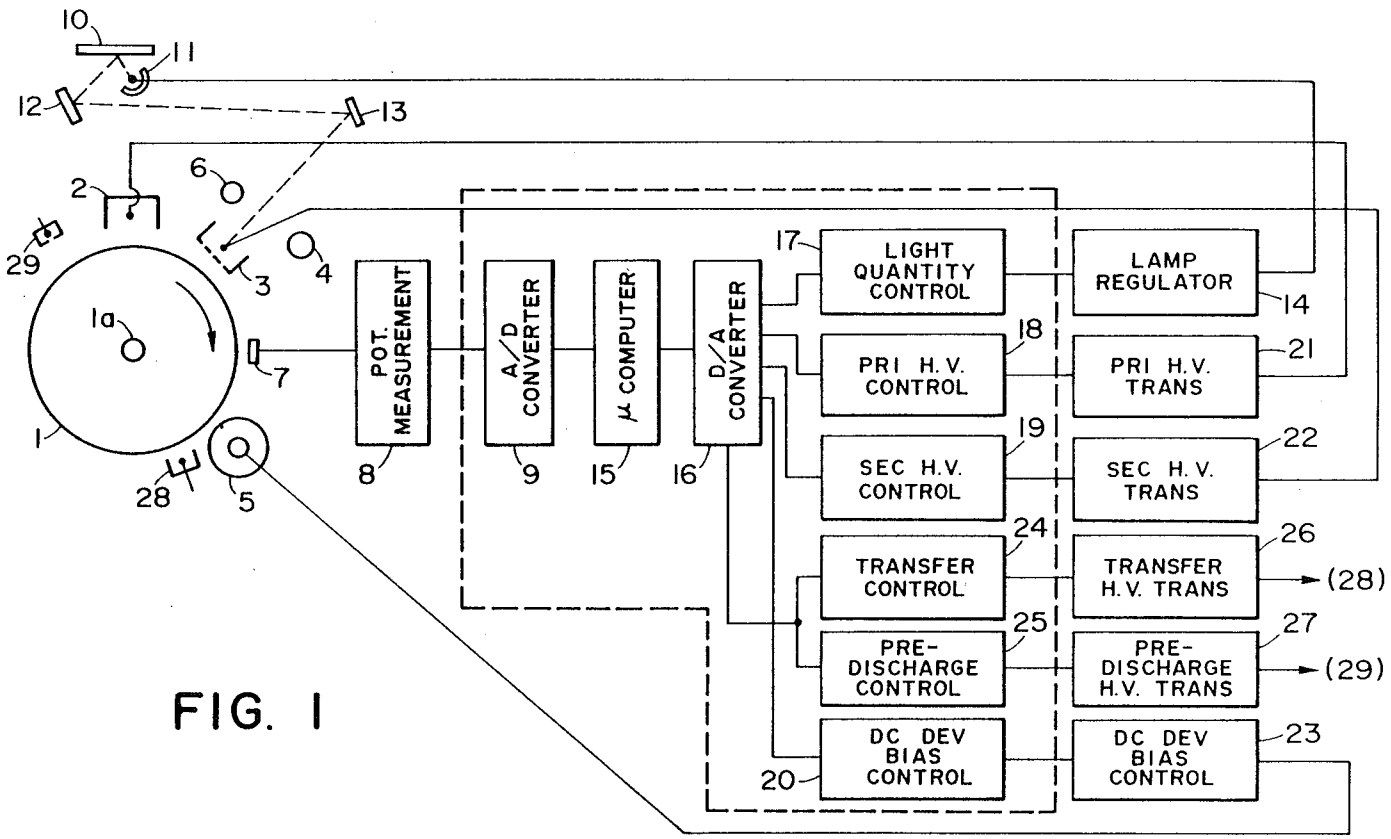
FIG. 1 shows a schematic configuration of an electrostatic recording apparatus, FIGS. 2A, B, C and D and 3A, B, C and D show detailed circuit diagrams of portions of FIG. 1, FIGS. 4A, B-1, B-2, and C show control flow charts, FIGS. 5A, B, C and D show a time chart.
Figure 2A:
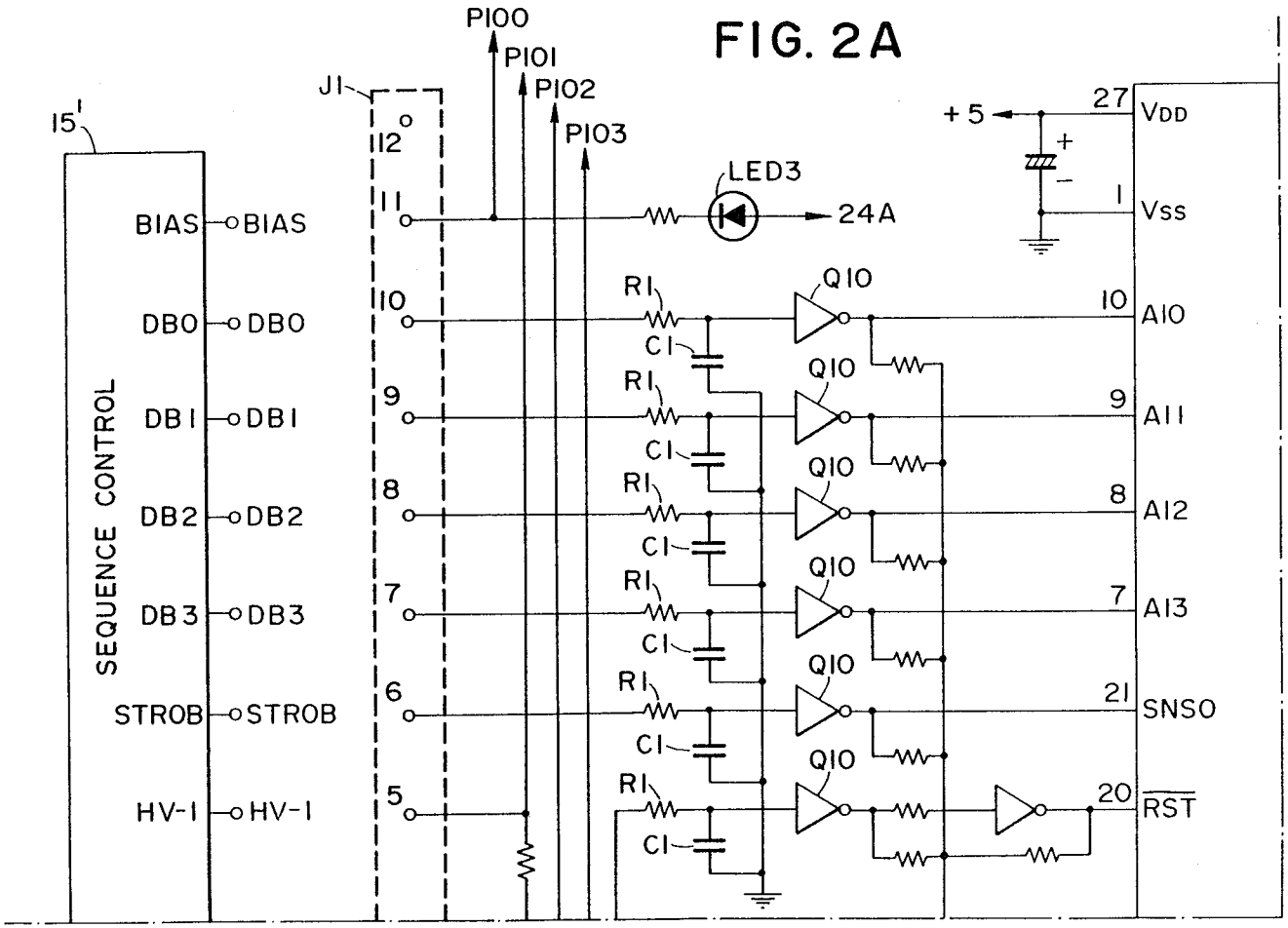
Figure 2B:
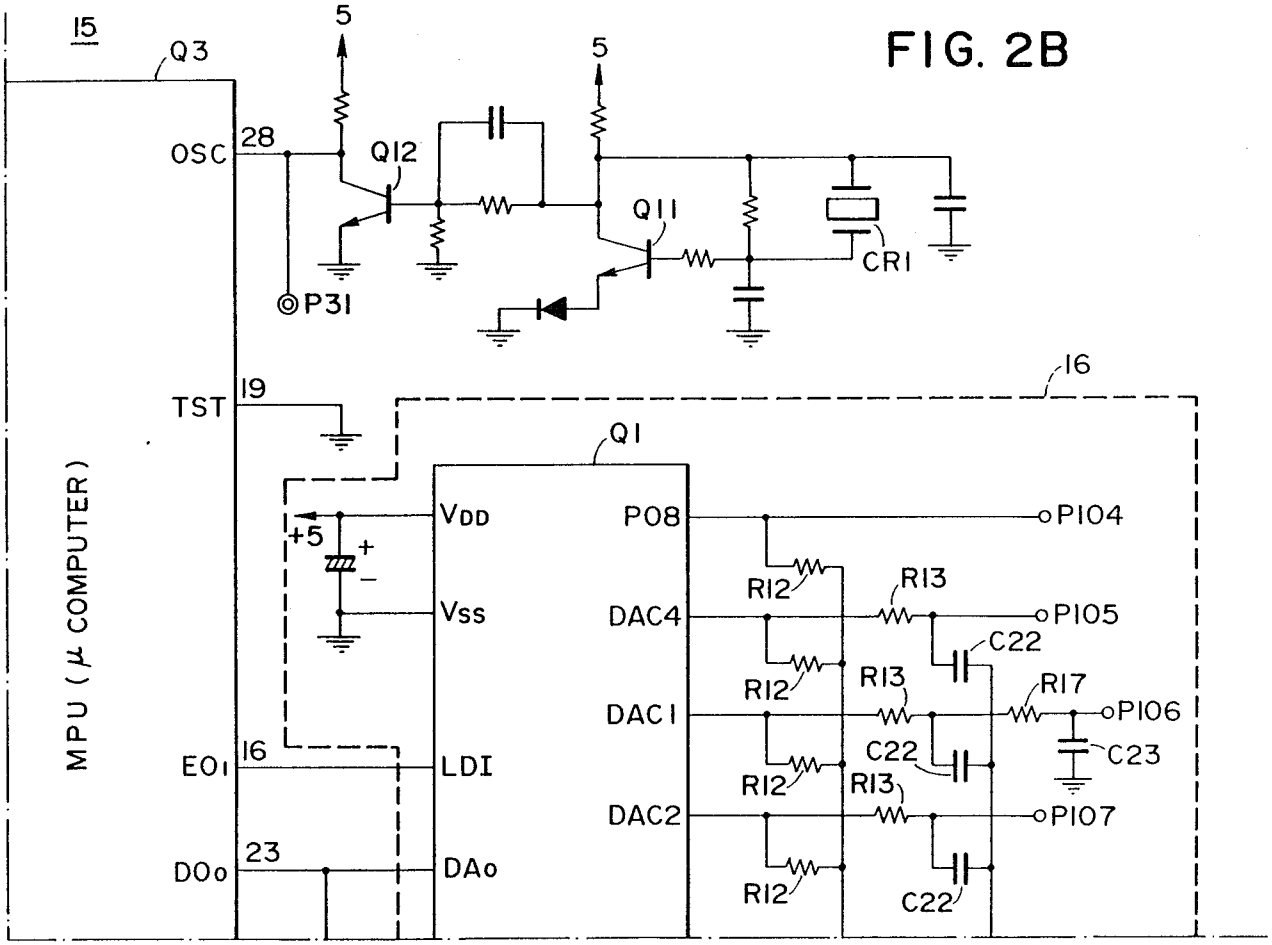
Figure 2C:
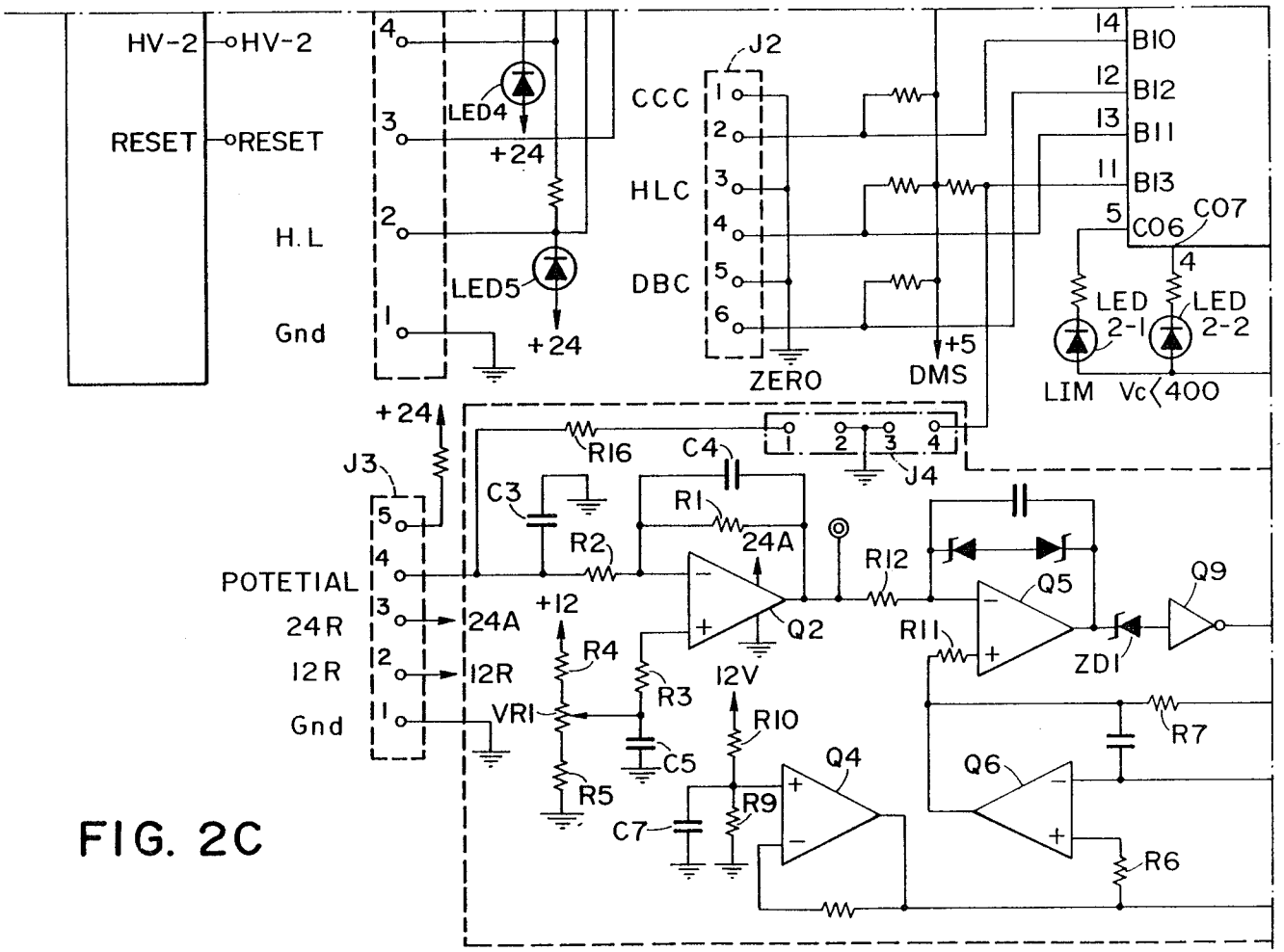
Figure 2D:
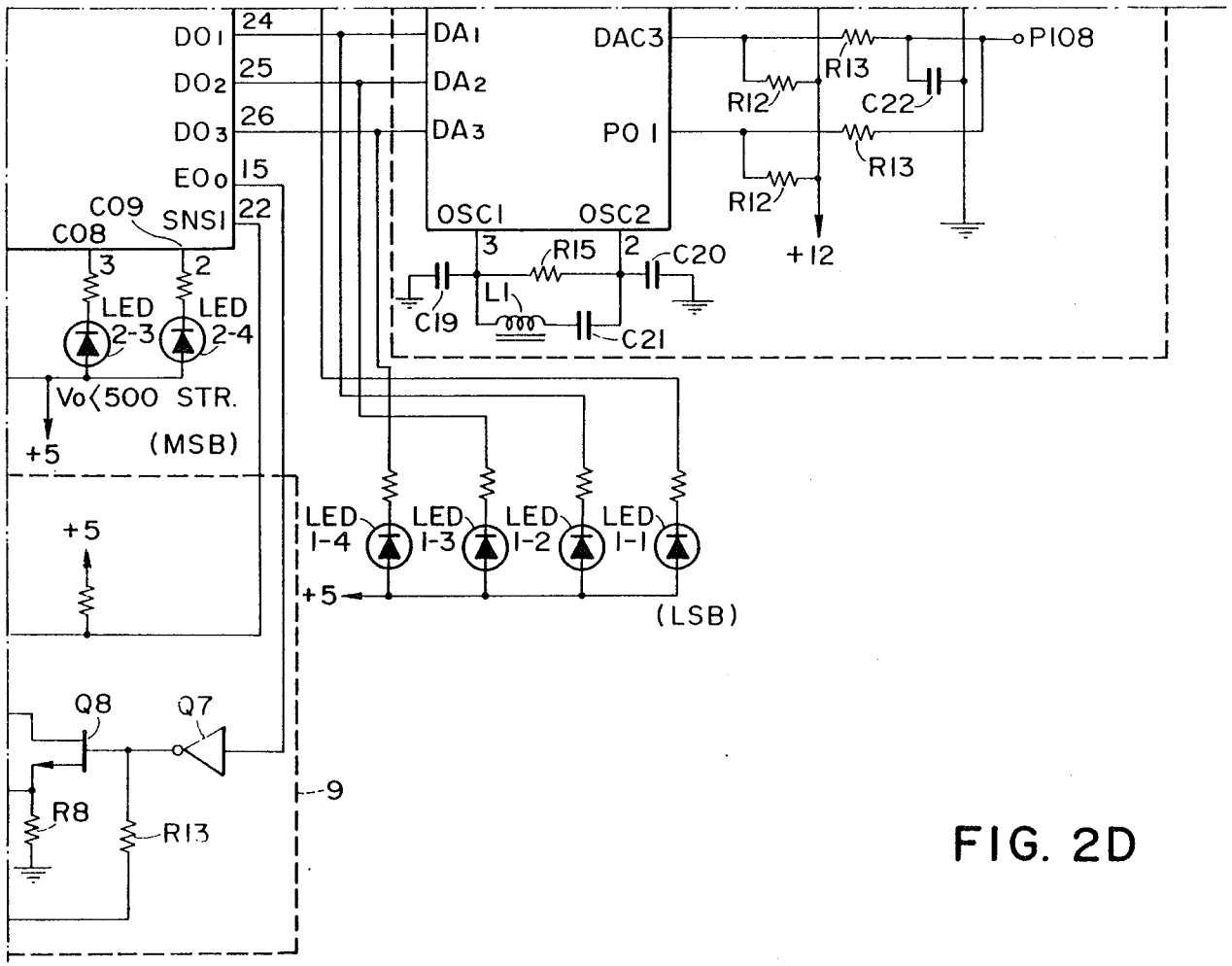
Figure 3A:
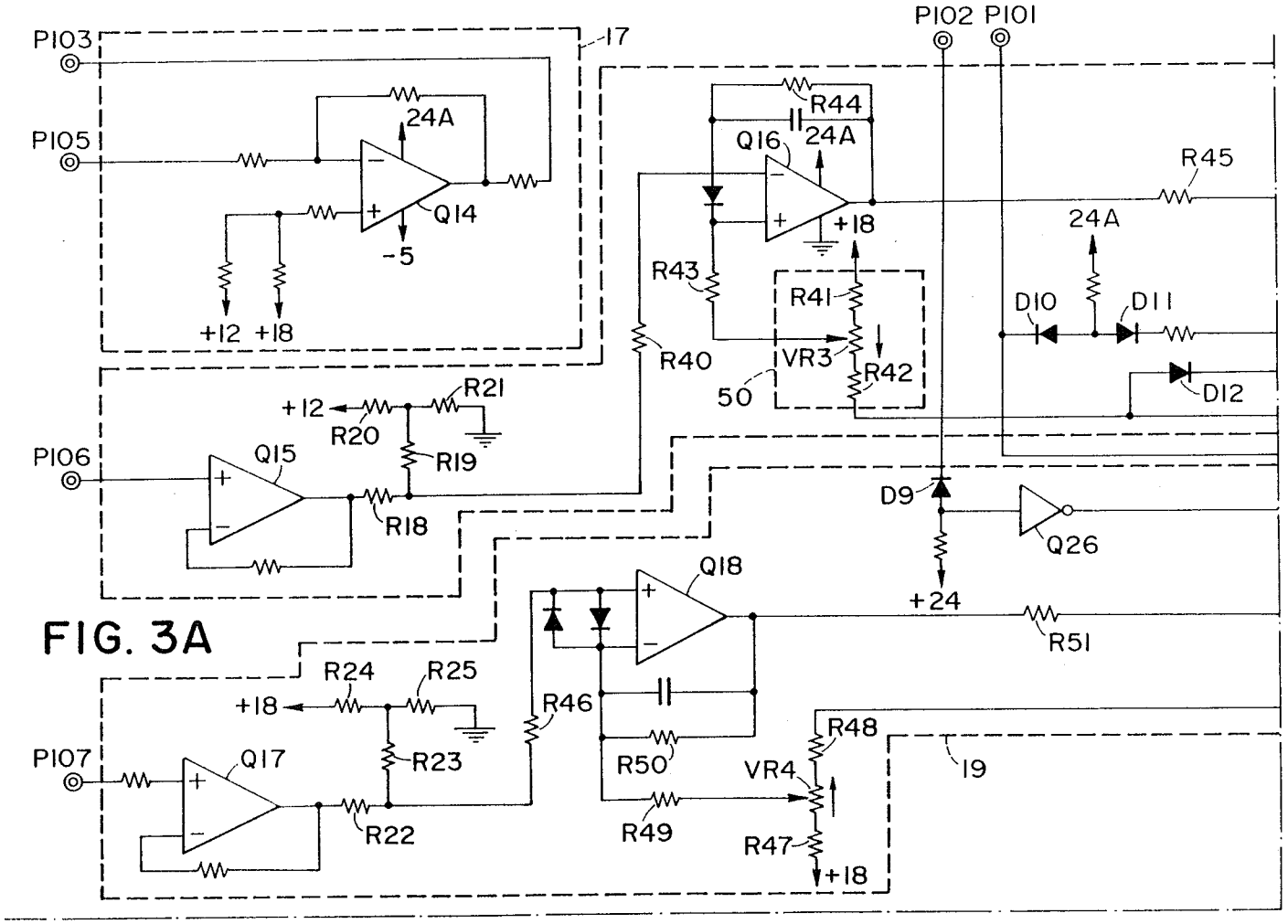
Figure 3B:
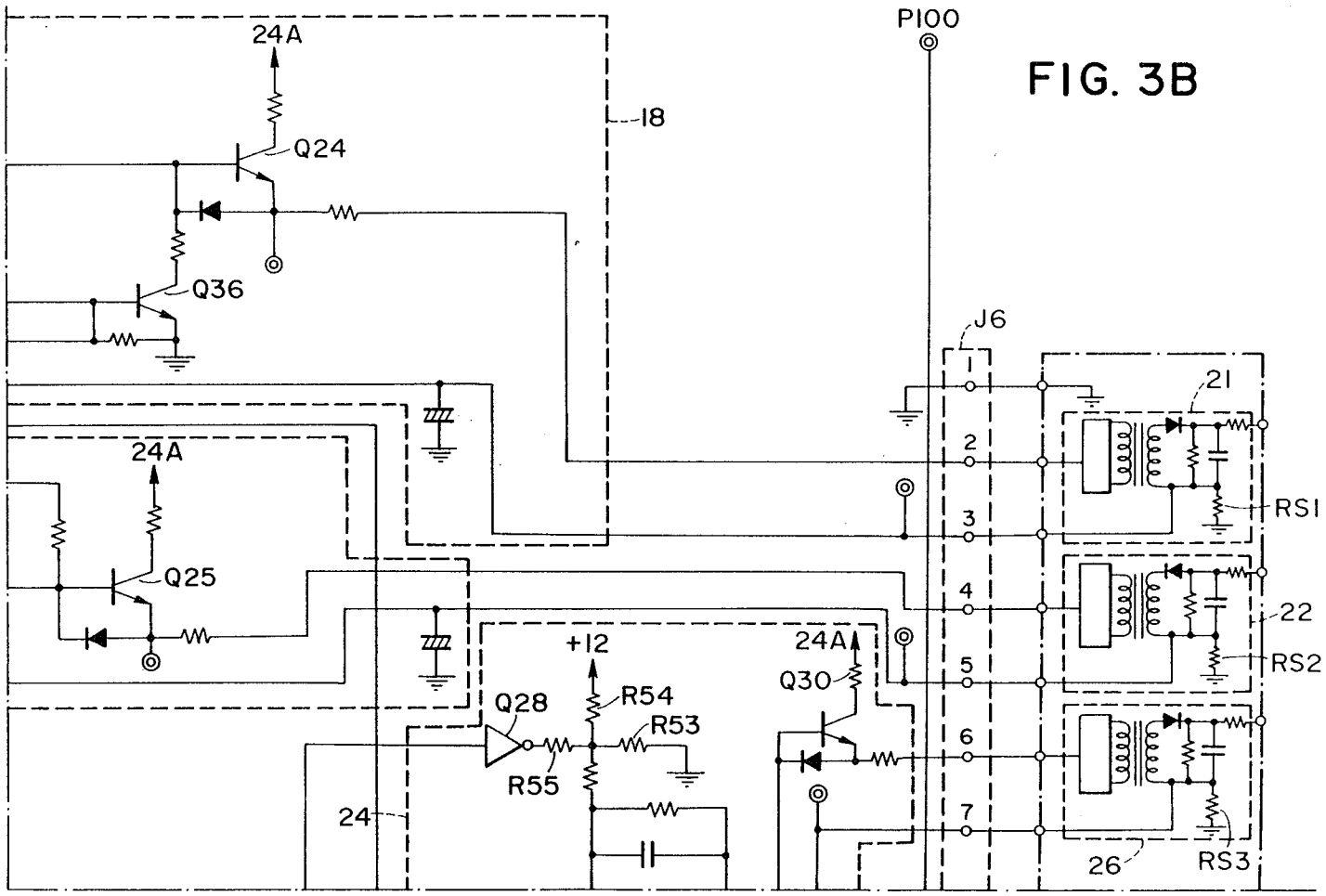
Figure 3C:
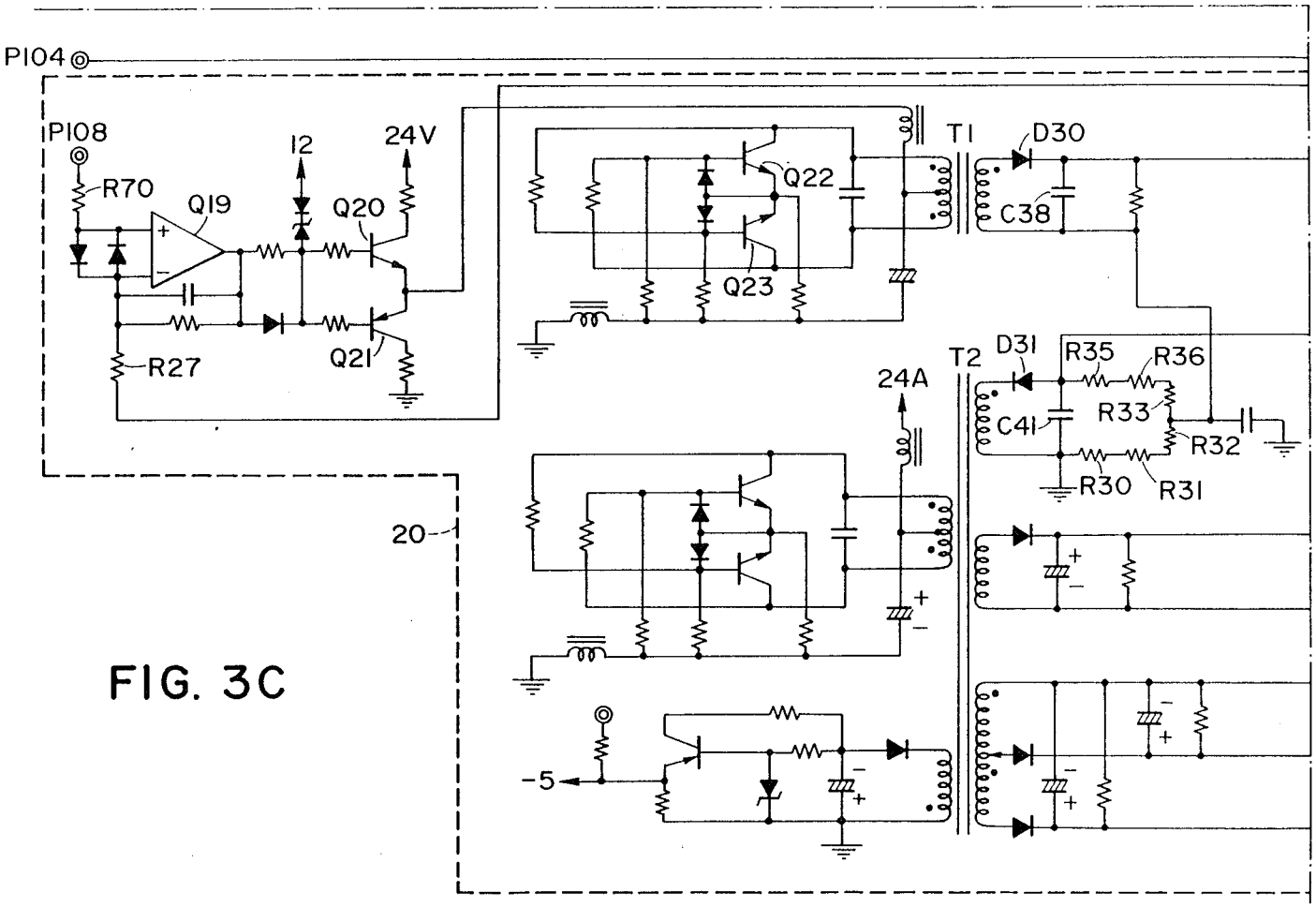
Figure 3D:
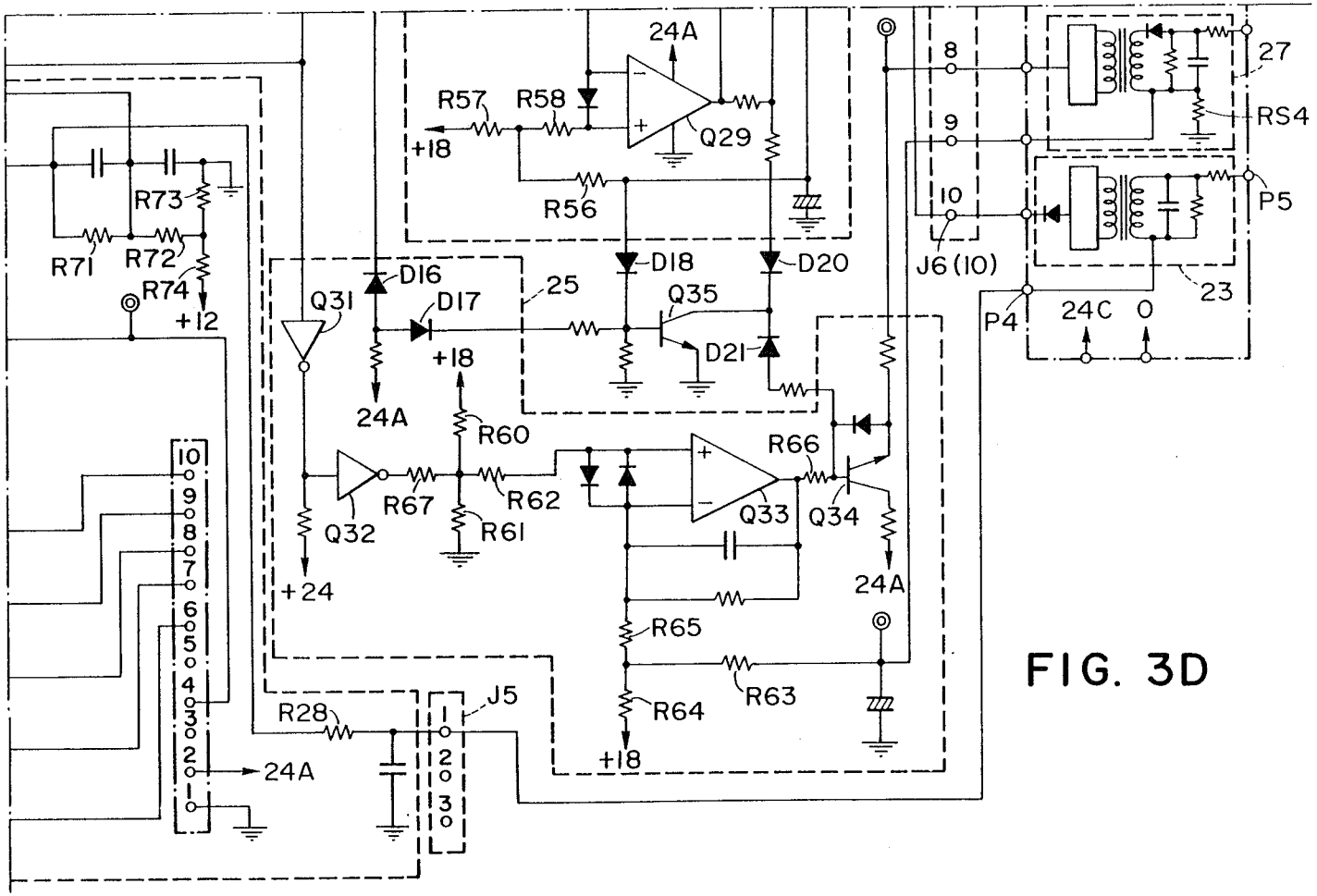

FIG. 1 shows a schematic configuration of the electrostatic recording apparatus of the present invention. A photosensitive member or a photosensitive drum 1 has three layers, an insulative layer, a photoconductive layer and a conductive layer and it is supported to a main frame (not shown) around a shaft 1*a* rotatably in the direction of an arrow. Arranged around the photosensitive drum 1 along the direction of rotation are a primary charger 2, a secondary charger 3, a flat exposure lamp 4, a potential sensor 7, a developing roll 5 of a developer, a transfer charger 28 and a predischarging charger 29.

The photosensitive drum 1 is predischarged by the charger 29 prior to the process and then uniformly charged by the primary charger 2. A text 10 illuminated by a text exposure lamp 11 is exposed to the photosensitive drum 1 through mirrors 12 and 13. Simultaneously with the exposure of the text, the photosensitive drum is discharged by the secondary charger 3 in accordance with the text image to form a latent image. Then it is exposed over the entire surface by the flat exposure lamp 4 and toner development is carried out by the developing roll 5. As will be explained later, a bias voltage is applied to the developing roll 5 to improve tone of the image. Then the transfer charge 28 is activated to transfer the image to a record paper (not shown).

By turning on and off a blank exposure lamp 6 prior to the recording of the image, a dark area potential $V_D$ and a bright area potential $V_{SL}$ are established on the photoconductive drum 1. Those potentials are detected by the surface potential sensor 7 located with respect to the photosensitive drum 1 between the flat exposure lamp 4 and the developing roll (developing electrode) 5 and measured by a potential measurement circuit 8 as analog quantities. The surface potentials thus measured are converted to digital quantities by an A/D converter circuit 9 and processed in a microcomputer (MPU) 15. The MPU 15 produces control data such that the bright area potential and the dark area potential approach target values. The data are converted to analog quantities by a D/A converter circuit 16 and the analog quantities are supplied to primary and secondary high voltage control circuits 18 and 19. The primary high voltage control circuit 18 controls a primary high voltage transformer 21 to control a charge quantity of the primary charger 2. The secondary high voltage control circuit 19 controls a primary high voltage transformer 22 to control a charge quantity of the secondary charger 3. In this manner, the bright area potential $V_{SL}$ and the dark area potential $V_D$ are controlled to approach the target values.

A standard white plate (not shown) located beyond the image area of the text 10 is illuminated to adjust the exposure quantity of the text exposure lamp 11. A first illumination is carried out by converting a predetermined data produced from the MPU 15 to an analog quantity by the D/A converter circuit 16 and supplying a voltage regulated by a lamp regulator 14 through a light quantity control circuit 17 to the exposure lamp 11. A light reflected by the standard white plate in the first exposure is directed onto the photosensitive drum 1 through mirrors 12 and 13 and a potential VL1 corresponding to a white background established on the surface of the drum 1 is measured by the potential sensor 7 and the potential measurement circuit 8. The measured potential is then converted to digital data by the A/D converter circuit 9 and the digital data is supplied to the MPU 15 where it is processed in accordance with a predetermined approximation function representing a corelation between the exposure quantity and the surface potential. The processed result is converted to an analog quantity by the D/A converter circuit 16 and the lamp regulator 14 is driven through the light quantity control circuit 17 such that the white background potential reaches the target value to control the exposure quantity of the exposure lamp 11. The measurement of VL1 and the adjustment of the exposure quantity by the measured potential are repeated three times and the exposure quantity finally determined is irradiated to the photosensitive drum 1, and a surface potential VL2 at the illuminated area is measured by the potential sensor 7. The measured potential VL2 is supplied to the MPU 15 through the A/D converter circuit 9. The MPU 15 processes the potential VL2 in such a manner that it adds +100 V to the measured potential VL2. The processed result is converted to an analog quantity by the D/A converter circuit 16, which drives a D.C. developing bias control circuit 20 to produce a proper developing bias. In the D.C. developing bias control circuit 20, the text exposure control is further corrected. After the white background potential has been converged to approximately zero volt by the text exposure control, the developing bias is determined to produce the proper developing bias which assures fog free image.

The output of the D.C. developing bias control circuit 20 is supplied to an A.C. developing bias control circuit 23 in which an A.C. bias voltage of 1300 V P—P at 1 KHz is superimposed. The A.C. bias functions to reproduce the tone of the image with a high fidelity. The developing bias voltage produced by the D.C. developing bias control circuit 20 and the A.C. developing bias control circuit 23 is applied to the electrode of the developing roll 5 and the toner development is carried out by a jumping development process. Regarding the jumping development process by the developing bias, reference may be made to Japanese published unexamined patent application No. 55-18656, for example.

The control operations described above may be carried out in the procedures shown in FIG. 4 under the control of the MPU 15 which receives instructions from means for managing the sequences of the entire system.

The predischarging process and the transfer process after the development are also controlled by the MPU 15. After the data processed by the MPU 15 have been converted to the analog quantities by the D/A converter circuit 16, a transfer high voltage transformer 26 and a predischarge high voltage transformer 27 are controlled by a transfer control circuit 24 and a predischarge control circuit 25, respectively, to control the chargers 28 and 29 so that the transfer steps and the discharge steps in equi-scale reproduction and enlarged/reduced scale reproduction are controlled.

In the present invention, the image formation condition is controlled in accordance with the surface potential of the photosensitive member as explained above.

Figure 4A:
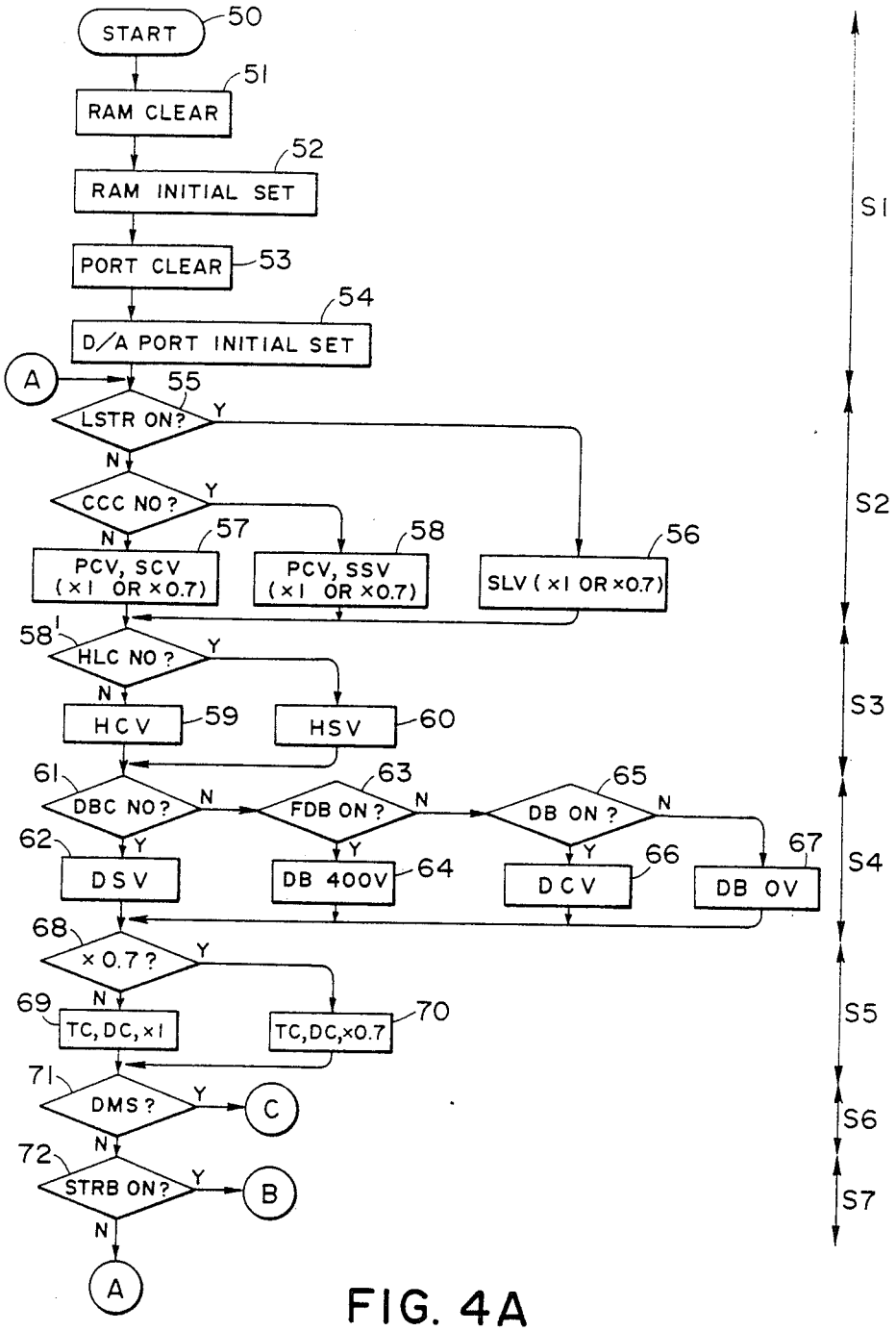
Figures 1, 4B:
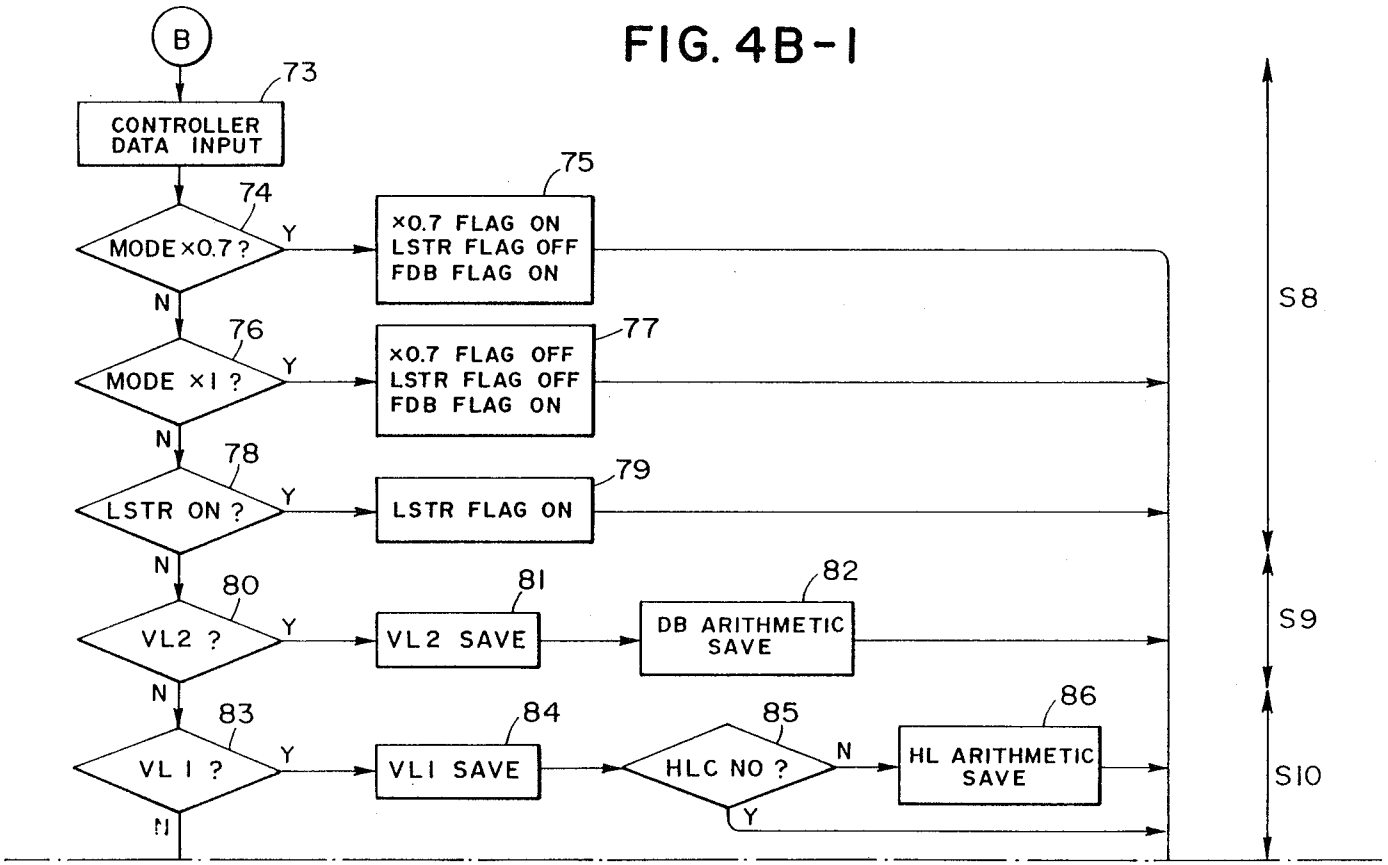
Figures 2, 4B:
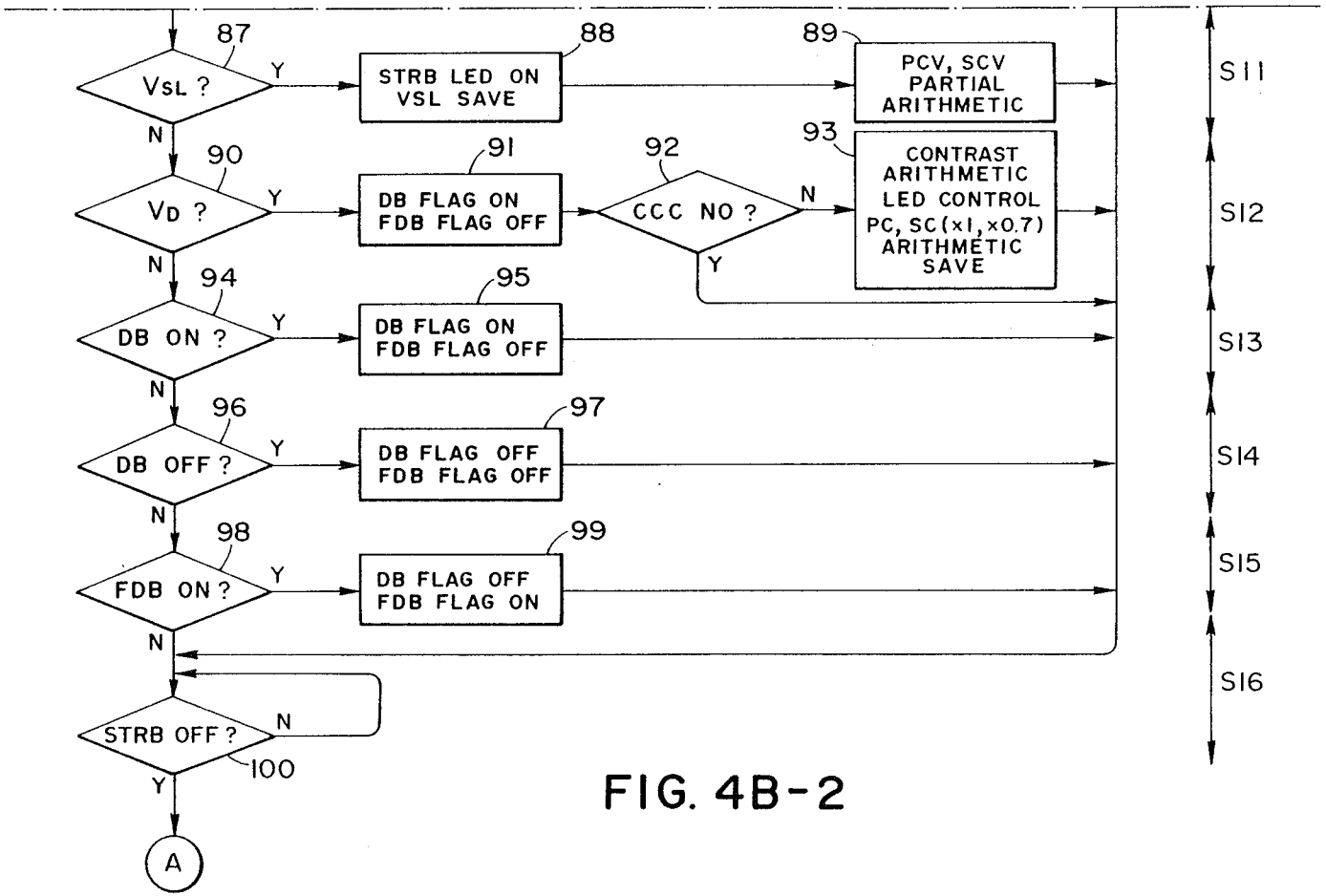
Figure 4C:
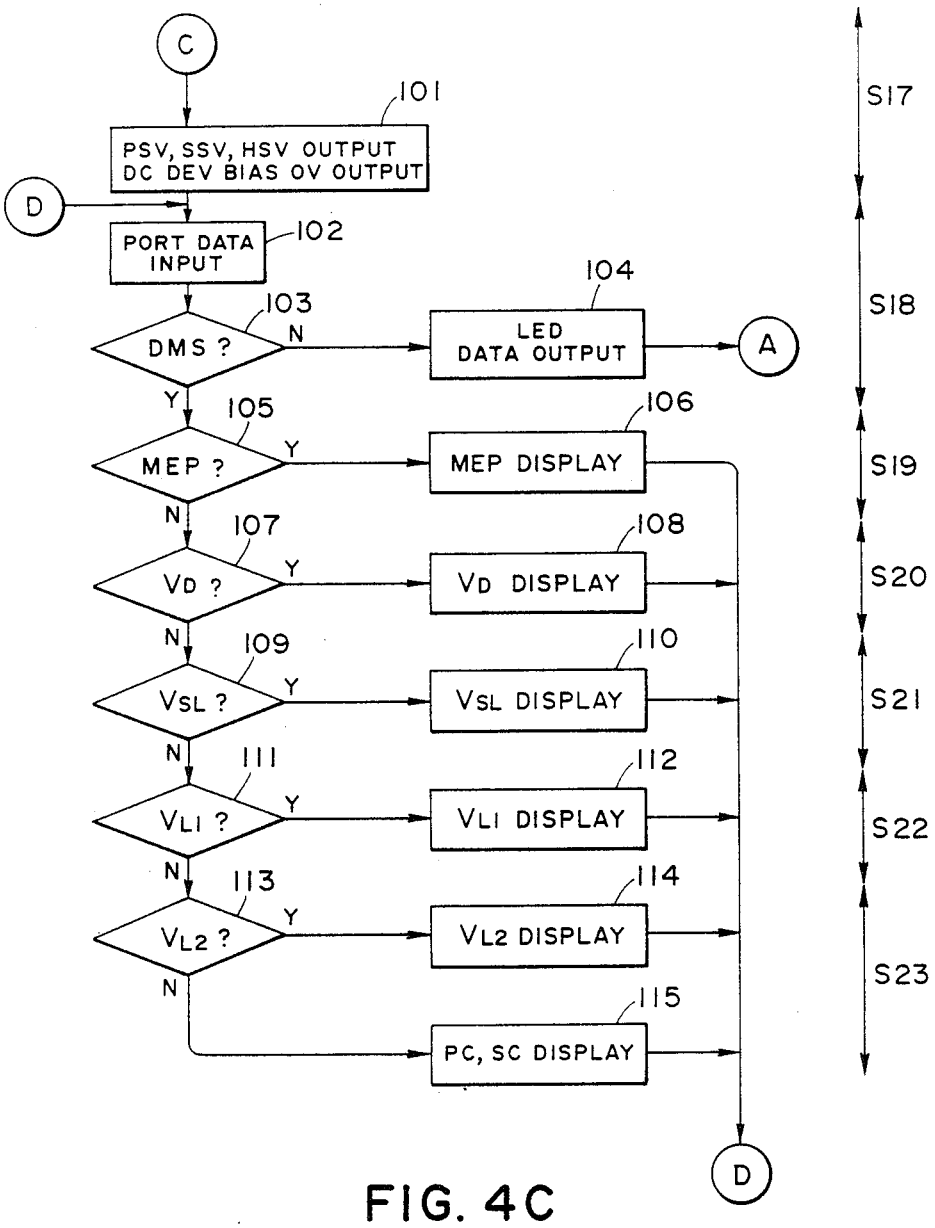
Figure 5A:
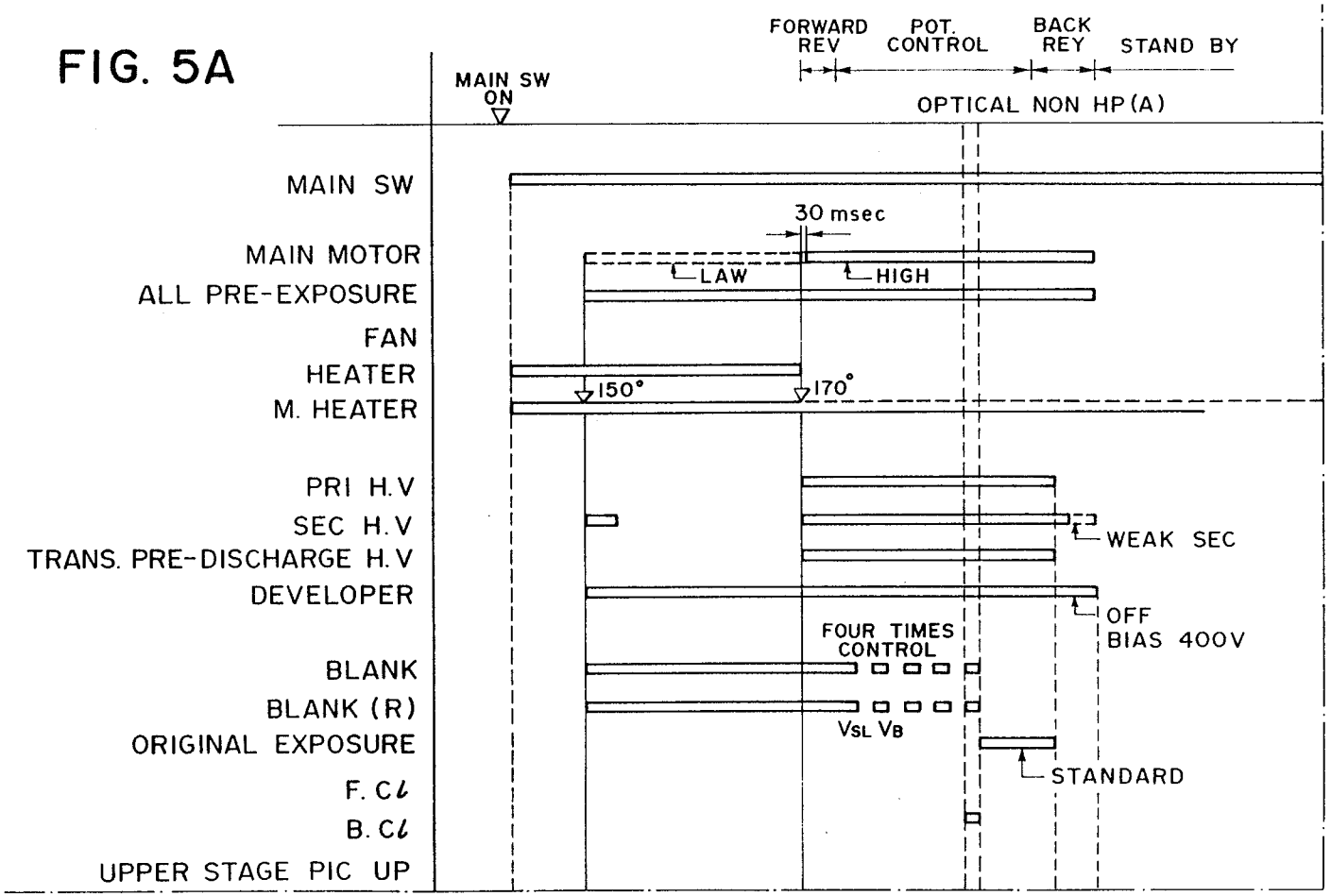
Figure 5B:
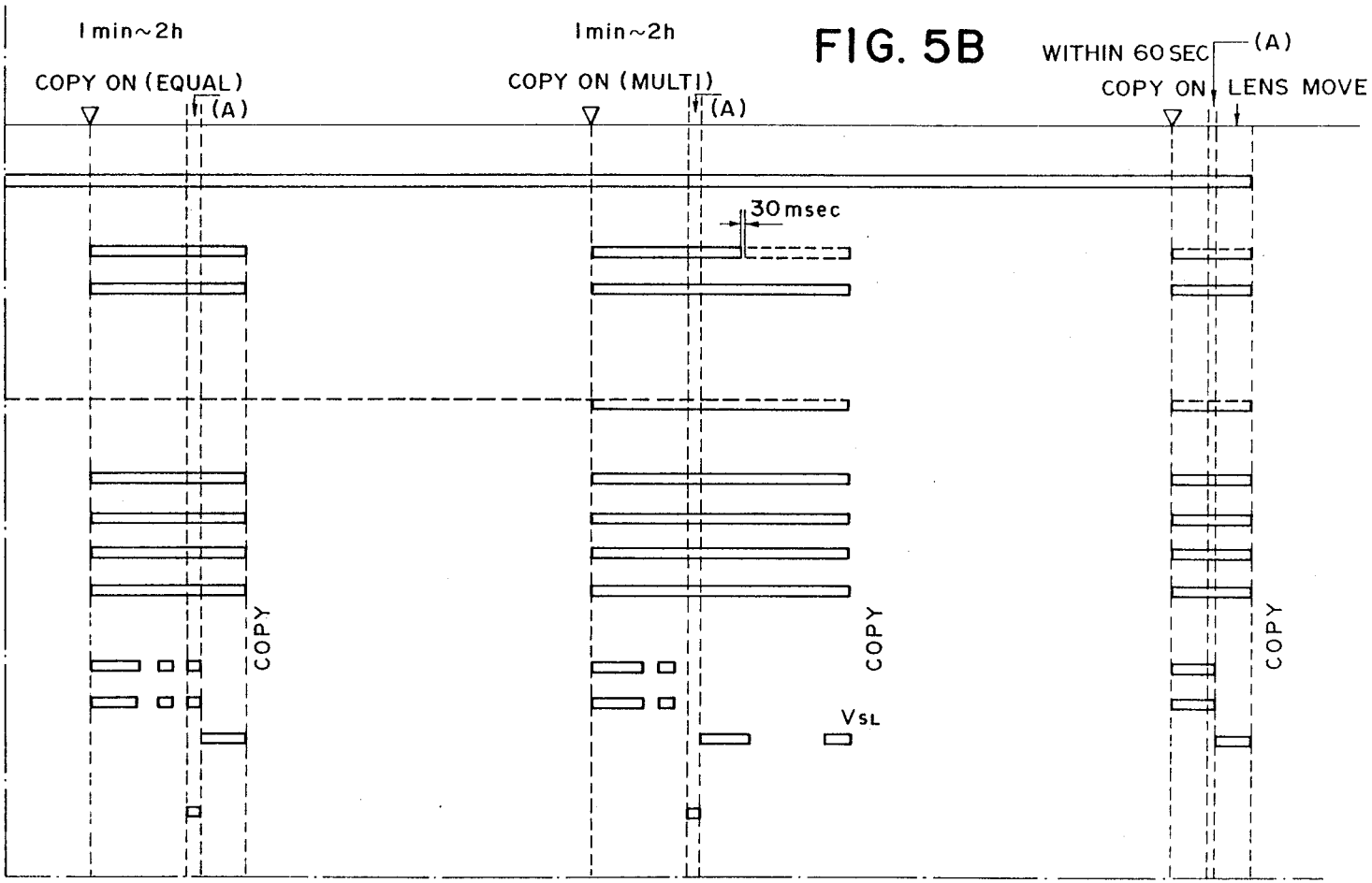
Figure 5C:
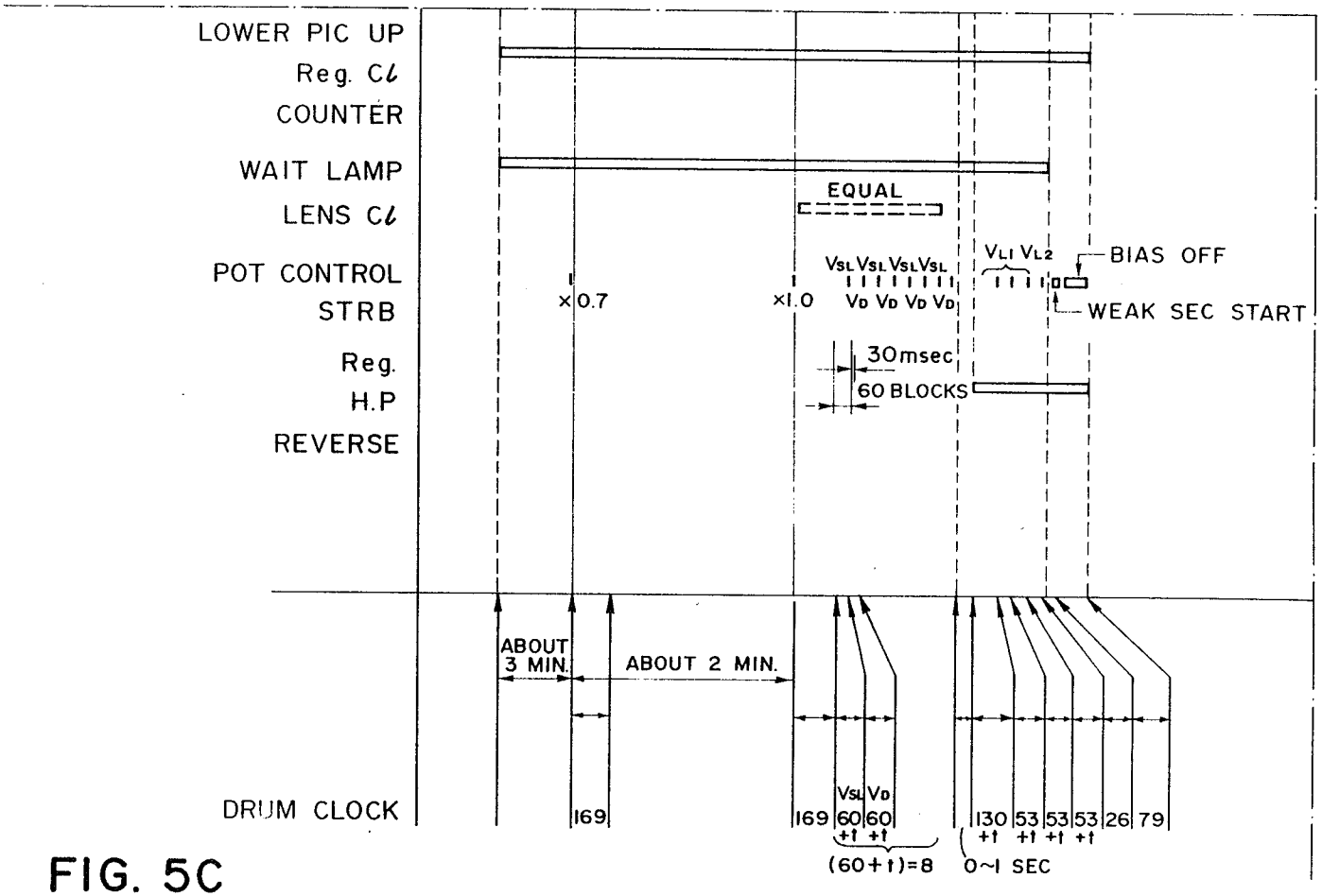
Figure 5D:
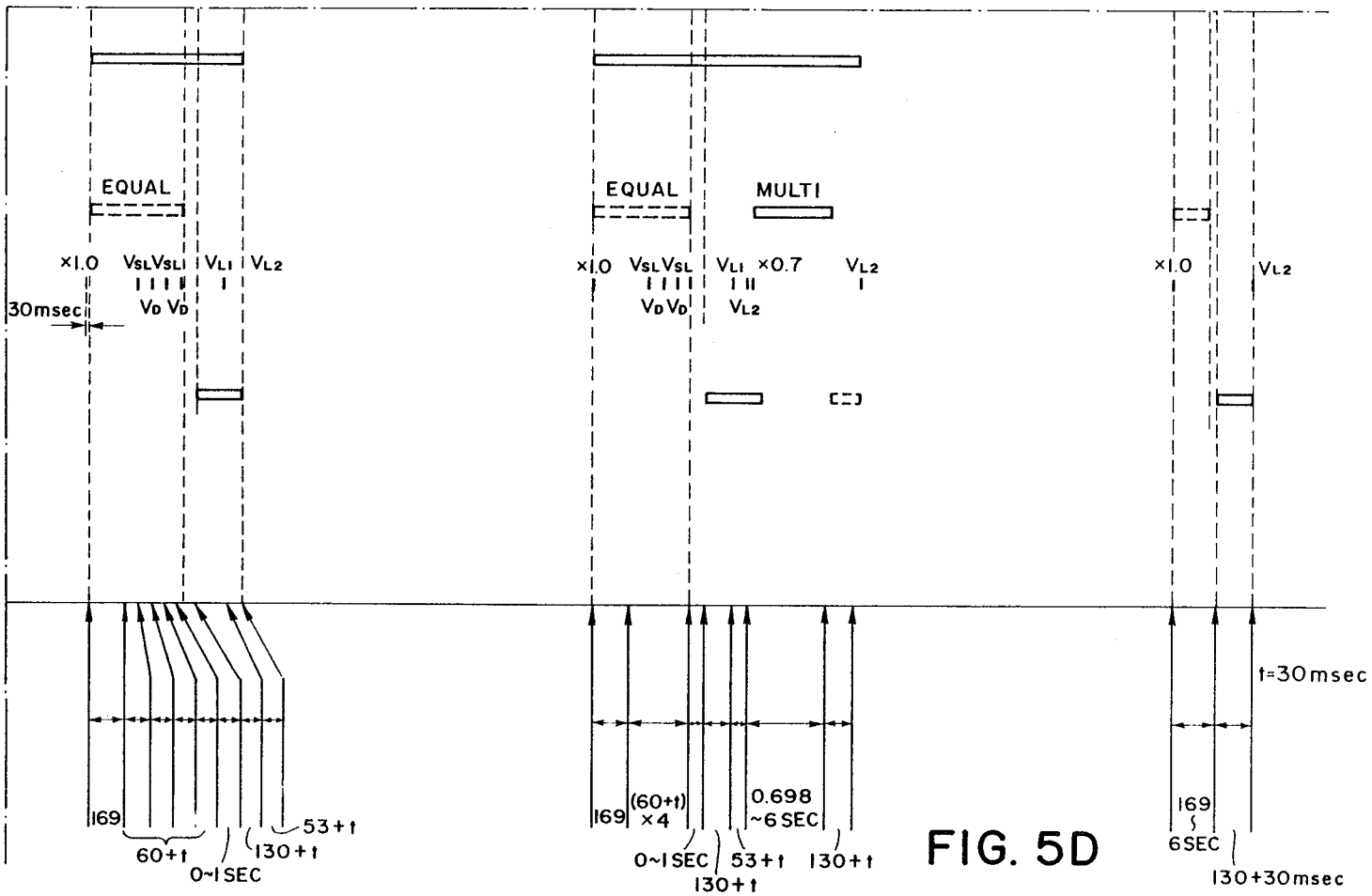

Referring to FIGS. 2 and 3, the control circuits shown in FIG. 1 are explained in further detail.

The MPU (microcomputer) 15 receives control signals DB0, DB1, DB2, DB3, STROB and RESET in a predetermined sequence from a microcomputer (sequence controller) 15' which controls the overall sequence, and carries out the operations described above in a sequence determined by a ROM in a MPU chip Q3. The sequence controller 15' also supplies a primary high voltage turn-on signal (HV-1), a secondary high voltage turn-on signal (HV-2), an A.C. developing bias turn-on signal (BIAS) to the primary high voltage control circuit 18, the secondary high voltage control circuit 19 and the A.C. developing bias control circuit 23, respectively, to control the high voltages and the A.C. developing bias. The signals are filtered by resistors R1 and capacitors C1 to eliminate noises, and inverted and level-shifted by inverters Q10, output of which are supplied to the corresponding inputs of the MPU Q3.

The control signal RESET functions to initialize the MPU Q3. The signals DB0~DB3 indicate the contents as shown in Table 1 by the combinations of "H" and "L" and the MPU 15 processes them. In the prior art apparatus, since the inputs to the potential controlling MPU 15 are not encoded, the number of signal lines increases considerably as the control is complexed. In the present embodiment, since a maximum of sixteen states can be specified by four-bit data, the number of signal lines can be reduced.

TABLE 1

| DB3 | DB2 | DB1 | | DB0 | |
|---|---|---|---|---|---|
| 0 | 0 | 0 | 0 | NOP | |
| 0 | 0 | 0 | 1 | NOP | |
| 0 | 0 | 1 | 0 | NOP | |
| 0 | 0 | 1 | 1 | NOP | |
| 0 | 1 | 0 | 0 | DB OFF, FDB ON | |
| 0 | 1 | 0 | 1 | DB OFF, FDB OFF | 1 |
| 0 | 1 | 1 | 0 | DB ON, FDB OFF | |
| 0 | 1 | 1 | 1 | $V_D$ TS | |
| 1 | 0 | 0 | 0 | $V_D$ TS | |
| 1 | 0 | 0 | 1 | $V_{SL}$ TS | 2 |
| 1 | 0 | 1 | 0 | $V_{L1}$ TS | |
| 1 | 0 | 1 | 1 | LSTR ON | |
| 1 | 1 | 0 | 0 | NOP | |
| 1 | 1 | 0 | 1 | NOP | |
| 1 | 1 | 1 | 0 | X1, LSTR OFF, FDB ON | |

TABLE 1-continued

| DB3 | DB2 | DB1 | | DB0 |
|---|---|---|---|---|
| 1 | 1 | 1 | 1 | X0.7, LSTR OFF, FDB ON |

In the Table 1, DB ON indicates that the developing bias control circuit 20 is on, FDB ON indicates that a D.C. bias voltage of approximately +400 V is generated to prevent the deposition of the toner to the photoconductor drum 1 during the non-developing period, LSTR ON is a data to indicate the turn-on of a weak secondary voltage during a post-rotation period, $V_D$TS is a measurment timing signal to indicate that the potential sensor is measuring the dark area potential $V_D$, $V_{SL}$ TS is a measurement timing signal for the bright area potential $V_{SL}$, $V_{L1}$ TS is a measurement timing signal for the potential $V_{L1}$ by the standard white plate irradiation, and $V_{L2}$ TS is a measurement timing signal for the surface potential $V_{L2}$ by the standard white plate irradiation by the exposure quantity determined in accordance with a desired characteristic based on the potential $V_L$, and X1 and X0.7 are data for specifying the equi-scale and reduced scale reproductions.

The MPU Q3 determines whether the potential currently measured is the bright area potential $V_{SL}$ or the dark area potential $V_D$, or the potential $V_{L1}$ by the standard white plate irradiation in accordance with the data of the Table 1 supplied to ports A10~A13, reads in the A/D converted surface potential data to be described later, processes the data and supplies the processed results to a D/A converter Q1 of the D/A converter circuit 16 through ports DO0–DO3 as the primary high voltage control signal, secondary high voltage control signal, light quantity control signal and D.C. developing bias control signal. By shorting pins 1 and 2 (CCC), pins 3 and 4 (HLC) and pins 5 and 6 (DBC), respectively, of J2, it is possible to supply to the D/A converter Q1 a signal which causes reference currents to flow into the primary and secondary chargers 2 and 3, a reference lamp voltage for the text exposure lamp 11 and a reference D.C. developing bias, irrespective of the control signals.

The surface potential measured by the surface potential sensor 7 and the potential measurement circuit 8 which are described in detail in Japanese published unexamined patent application No. 55-142363 is applied to a pin 4 (POTENTIAL) of J3. It is supplied to an inverting input terminal of an operational amplifier Q2 through a resistor R2 and inverseamplified with a gain determined by a ratio of the resistors R1 and R2. A bias of approximately +6 V which is derived by dividing a power supply voltage of +12 V by resistors R4, VR1 and R5 is supplied to a non-inverting input terminal of the operational amplifier Q2 through a resistor R3. A level of the measurement potential can be adjusted by the potentiometer VR1. Capacitors C3, C4 and C5 are inserted to eliminate the noises. A voltage ranging from approximately 9 V to 14 V appears at the output of the operational amplifier Q2 dependin on the measured surface potential. The resulting low impedance signal is supplied to an A/D converter section of the A/D converter circuit 9 which comprises operational amplifiers Q4, Q5 and Q6. The MPU Q3 produces an A/D conversion start signal at a pin 15 of the MPU Q3, which is normally "H". Accordingly, an output of an inverter Q7 is "L" and zero bias is applied across a gate and a source of an FET Q8 so that the FET Q8 conducts between the source and the drain. As a result, the output of the operational amplifier Q6 is at a predetermined reference level (A/D start voltage).

The output of the operational amplifier Q4 applied to the non-inverting input terminal of the operational amplifier Q6 through the resistor R6 is set to be equal to the output of the operational amplifier Q6 divided by the resistors R7 and R8. The operational amplifier Q4 generates a reference voltage for that purpose and it is derived by buffering the power supply voltage of 12V divided by resistors R10 and R9 by the operational amplifier Q4. The output of the operational amplifier Q6 is supplied to the non-inverting input terminal of the operational amplifier Q5 through a resistor R11, and a voltage corresponding to the measurement voltage is supplied to the inverting input terminal through a resistor R12. The operational amplifier Q5 forms a compare circuit. Before the start of the A/D conversion, the inverting input is at higher potential than the non-inverting input so that the operational amplifier Q5 produces an output of approximately 0 V. The output of the operational amplifier Q5 is level-shifted by a zener diode ZD1 and then applied to an inverter Q9. As a result the inverter Q9 is turned off producing an "H" output. This signal is supplied to the MPU Q3 as an A/D conversion end signal.

The A/D conversion is started in response to the "H" to "L" transition of the STROB signal from the sequence controller 15'. When the STROB signal changes, the MPU Q3 determines the status of the measurement potential to be A/D converted in accordance with the combination of DB0~DB3, and changes the AD start signal (at terminal EOO) from "H" to "L". As a result, the inverter Q7 is turned off and the reference voltage from the output of the operational amplifier Q4 is supplied to the gate of the FET Q8 through a resistor R13 so that the source-drain circuit of the FET Q8 is turned off Since the output voltage of the operational amplifier Q4 is supplied to the non-inverting input terminal of the operational amplifier Q6 through the resistor R6, when the FET Q8 is turned off, an integration loop is formed at the output of the operational amplifier Q6 through the capacitor C8 and the resistor R8 so that the output of the operational amplifier Q6 linearly charges the capacitor C8 through the resistor R8 starting from the predetermined reference voltage until the A/D conversion start signal is inverted and the FET Q8 conducts. When the FET Q8 conducts, the charge stored in the capacitor C8 is discharged through the resistor R7 so that the output of the operational amplifier Q6 rapidly falls to the reference voltage.

A predetermined time period after the start of the integration by the A/D conversion start signal, the MPU Q3 starts to count. The counting is continued until the output of the operational amplifier Q6 linearly rises and the noninverting input of the comparator Q5 exceeds the inverting input, when the output of the comparator Q5 is inverted so that the inverter Q9 is turned on to produce the "L" output. At this time, the MPU Q3 determines the end of count and the A/D conversion is terminated. At the end point, the MPU Q3 inverts the A/D conversion start pulse applied to the inverter Q7 to conduct the FET Q8 so that the output of the operational amplifier Q6 rapidly falls to the reference voltage. The MPU Q3 process the count as the A/D converted data for the measurement potential specified by the signals DB0~DB3 in accordance with a flow chart to be described later. The signals DB0~DB3 and STROB are filtered by the integration circuits comprising the resistors R1 and the capacitors C1 to eliminate the noises, and then supplied to the MPU Q3 through the inverters Q10.

In the present embodiment, the MPU Q3 consists of a NMOS one-chip four-bit microcomputer (MN1400). The following signals shown in Table 2 are inputted to or outputted from the terminals of the MPU Q3.

TABLE 2

| Terminal | Pin No. | Input/ Output | | |
|---|---|---|---|---|
| VSS | 1 | | GND | |
| C09 | 2 | Out | LED2-4 output (STR display) | |
| C08 | 3 | Out | LED2-3 output (contrast of more than 500 V) | |
| C07 | 4 | Out | LED2-2 output (contrast of 400 V) | |
| C06 | 5 | Out | LED 2-1 output (LIM display) | |
| C05 | 6 | | not used | |
| AI3 | 7 | In | Data bus DB3 input | |
| AI12 | 8 | In | Data bus DB2 input | |
| AI11 | 9 | In | Data bus DB1 input | |
| AI10 | 10 | In | Data bus DB0 input | |
| BI3 | 11 | In | Test | |
| BI2 | 12 | In | HLC: light quantity control on "1" | |
| BI1 | 13 | In | DBC: developing bias control in "1" | |
| BI0 | 14 | In | EPC: potential control on "1" | |
| E00 | 15 | Out | A/D conversion start signal | |
| E01 | 16 | Out | MN1204 LDI signal | |
| E02 | 17 | | not used | |
| E03 | 18 | | not used | |
| TST | 19 | | GND | |
| RST | 20 | In | Reset | |
| SNS0 | 21 | In | Strobe | |
| SNS1 | 22 | In | A/D conversion end signal | |
| D00 | 23 | Out | MN1204 data transfer output and | LED 1-1 |
| D01 | 24 | Out | | LED 1-2 |
| D02 | 25 | Out | | LED 1-3 |
| D03 | 26 | Out | | LED 1-4 |
| VDD | 27 | | +5 V power supply | |
| OSC | 28 | In | Clock input 495 KHz | |

By opening or closing the pins 1 and 2, the pins 3 and 4 and the pins 5 and 6 of J2, it is possible to switch the primary high voltage, the secondary high voltage, the light quantity and the D.C. developing bias between the control values and the reference values. In a copy standby mode, by changing the terminal B13 to "L", the indication contents as shown in Table 3 are generated by the combinations of "H" and "L" and they can be indicated by the eight-bit LED's 2-1, 2-2, 2-3, 2-4, 1-1, 1-2, 1-3 and 1-4 connected to the terminals C06, C07, C08, C09, D00, D01, D02 and D03 of the MPU Q3 (DMS mode). The primary and secondary currents are indicated by the four-bit LED's 1-1~1-4 and the four-bit LED's 2-1~2-4, respectively. When all of the four LED's are lit, it indicates that the current has reached a limit value.

TABLE 3

| Combination of Indication Sets | | | Contents of Indication | |
|---|---|---|---|---|
| D | H | C | LED | LED |
| B | L | C | 2-4 | 1-1 |
| C | C | C | MSB | LSB |
| 1 | 1 | 1 | measurement surface potential MEP | |
| 1 | 1 | 0 | VD | |
| 1 | 0 | 1 | VSL | |
| 1 | 0 | 0 | VL1 | |
| 0 | 1 | 1 | VL2 | |
| 0 | 1 | 0 | current indication | |
| | | | LED 1 . . . primary | |

TABLE 3-continued

| Combination of Indication Sets | | | Contents of Indication |
|---|---|---|---|
| 0 | 0 | 1 | LED 2 . . . secondary current indication |
| 0 | 0 | 0 | LED 1 . . . primary<br>LED 2 . . . secondary current indication |
| | | | LED 1 . . . primary<br>LED 2 . . . secondary |

Separately from the contents of the indication in the standby mode, it is possible to indicate the following contents to a user by the LED's 2-1~2-4 during the process operation.

The LED 2-1 is lit when the primary or secondary current control signal reaches an upper limit, the LED 2-2 is lit when a bright area - dark area potential difference (contrast) is lower than 400 V, the LED 2-3 is lit when the contrast is lower than 500 V, and the LED 2-4 to determine normal/abnormal state of the data supplied from the sequence controller 15' through the DB0~DB3. Those data sets of the four-bit data combination shown in the Table 1 which are complement to each other, that is, the data set VD−Ts and VSL−TS are checked and the LED 2-4 is turned off when one of the data sets is received. In a normal state, the LED 2-4 repeatedly flashes because VSL-Ts or VD-Ts is repeatedly supplied to the MPU Q3 several times by a requirement on the entire copy sequence. If a data line is disconnected or the inverter Q10 fails so that the data supplied is in error, the LED flash sequence in the normal state is lost so that the abnormal state is detected.

More particularly;

(1) In the normal state, the LED 2-4 is lit by the DATA 1 (VD TS), the LED 2-4 is turned off by the DATA 2 (VSL TS). Thus the LED is repeatedly turned on and off by the time sequence of the DATA 1 and DATA 2.

(2) When one or more data lines are broken, one or both of the complementary DATA 1 and DATA 2 are not transferred. Thus, if the LED is initially off, the LED is not lit or lit from a certain time point and kept on. If the LED is initially on, the LED is not turned off or turned off at a certain time point and kept off.

Thus, by watching the flash of the LED under the condition (1) or (2), the normal/abnormal state is determined so that the failure in the data lines can be detected.

By the use of the complementary data, the following advantages are achieved.

(a) By setting a time relation between the DATA 1 and the DATA 2 such that other data is not transferred after the DATA 1 has initially transferred and before the DATA 2 is transferred, (i) the abnormal state is detected if a data other than the DATA 2 is received following the DATA 1, and (ii) the abnormal state is detected if the DATA 2 is received following to a data other than the DATA 1.

In this manner, the abnormal state in the transferred data sequence can be detected and an error in other unit can be detected.

(b) By setting a time limit to an interval between the DATA 1 and the DATA 2 in addition to the condition (a), the precision of detection is enhanced.

(c) By transferring the DATA 1 and the DATA 2 at a constant cycle as a diagnose data, the data lines can be continuously checked.

(d) By transferring the DATA 1 and the DATA 2 and checking them, the abnormal state of the data lines can be detected.

A clock for the MPU Q3 is generated by an oscillation circuit which comprises a transistor Q11 and a ceramic resonator CR1. An oscillation signal produced at a collector of the transistor Q11 is pulse-shaped by a transistor Q12 and the shaped signal is supplied to the MPU Q3 as a 495 KHz clock in the present embodiment. In the present embodiment, the DMS mode terminal described above and a terminal connected to the pin 4 of the connector J3 (measurement potential signal line from the measurement circuit) through a resistor R16 can be simultaneously grounded by a one-touch action. Accordingly, the level of the A/D conversion section can be adjusted only by a substrate having the potential control circuit mounted thereon, without requiring any auxiliary means. By connecting all of the pins 1~4 of the connector J4, the voltage corresponding to zero volt surface potential is supplied to the A/D conversion section, and in the MED mode shown in the Table 3, that is, when all of the terminals of the connector J2 are opened, the zero volt indication appears on the LED's 1 and 2. Thus, the potentiometer VR1 may be adjusted to attain the indication of desired bits. The MPU Q3 and the D/A converter Q1 are interconnected through five lines including the four-bit data lines (DA0~DA3 inputs) and the control line (LDI input) for controlling the D/A converter Q1. At the rise of the signal to the LDI terminal, the MPU Q3 specifies to the D/A converter Q1 whether the data to be D/A converted is the primary current control data, the secondary current control data, the light quantity control data or the D.C. developing bias control data, by the four-bit signal applied to the terminals DA0~DA3. At the fall of the signal to the LDI terminal, the D/A converter Q1 latches the data at the terminals DA0~DA3 as the actual four-bit control data. By repeating the above operation twice, the eight-bit data is latched in the D/A converter Q1. The D/A converter Q1 includes four-bit, six-bit and twelve-bit binary counters which count clocks generated by capacitors C19, C20 and C21, a resistor R15 and an inductor L1, and compares the equality between the data applied to the terminals DA0~DA3 to produce pulses having duty ratios proportional to the input data at DAC 1~4.

The DAC 1 is connected to a compare equal output for the twelve-bit counter, the DAC 2 is connected to a compare equal output for the six-bit counter and the DAC 3 and DAC 4 are connected to compare equal outputs for the four-bit counter to produce the outputs at the respective resolutions.

The D/A converter Q1 has an expansion port function and the port can be turned on and off by the data supplied to the terminals DA0~DA3. In the present embodiment, a terminal P01 of the D/A converter Q1 is used to combine the ON/OFF signal with the output from the terminal DAC 3 through resistors R13 so that the four-bit output from the terminal DAC3 is expanded to the five-bit output. In this manner, the precision of the D.C. developing bias control circuit connected to the terminal DAC 3 is improved.

By turning on and off the terminal P08, the transfer and predischarge high voltage output currents can be switched between the equi-scale copy mode and the reduced scale copy mode.

Since the terminals DAC 1~4, PO1 and P08 are open drain output terminals, they produce pulse outputs which are pulled up to 12 V through pull-up resistors. The pulses at the terminals DAC 1~4 are integrated by integration circuits comprising resistors R13 and capacitors C22 to produce analog voltages.

The output at the terminal DAC 4 is integrated by the resistor R13 and the capacitor C22 and the integrated voltage is applied to a terminal P105 as the light quantity control voltage. This voltage is applied to an inverting amplifier circuit Q14 of the light quantity control circuit 17 (see FIG. 3) which produces a control signal changing from approximately 13.6 V~16 V to the lamp regulator at a terminal P103, thence it is applied to the lamp regulator 14 of FIG. 1 through the pin 2 of the connector J1 to control the lamp voltage of the text exposure lamp 11.

The output at the terminal DAC 1 is a pulse width modulated twelve-bit D/A converted output and it is integrated by the integration circuit comprising the resistor R13 and the capacitor C22 and a secondary filter comprising a resistor R17 and a capacitor C23, and the integrated voltage is applied to an operational amplifier Q15 of the primary high voltage control circuit 18 (see FIG. 3) through the terminal P106, which produces a primary high voltage control voltage in a predetermined voltage range through a resistor network comprising resistors R18–R21, which voltage is then applied to the high voltage control circuit including an operational amplifier Q16. In the present embodiment, since the output pulse from the terminal DAC has a pulse width of approximately 3 ms, the two-stage integration circuit comprising the resistor R13 and the capacitor C22, and the resistor R17 and the capacitor C23 is used to improve the high response and the smoothing efficiency.

The output from the terminal DAC 2 is integrated by the resistor R13 and the capacitor C22 and the integrated voltage is bufferred by an operational amplifier Q17 through the terminal P107, which produces a secondary high voltage control voltage in a predetermined voltage range through a resistor network comprising resistors R22–R25, which voltage is applied to the secondary high voltage control circuit including an operational amplifier Q18.

The output from the terminal DAC 3 is integrated by the associated resistor R13 and the capacitor C22 and the integrated voltage is applied to a terminal P108 to which the output at the terminal P01 is applied through the resistor R13 so that both voltages are combined. In the present embodiment, the combined voltage is set to be equal to one fiftyth (1/50) of the white background potential (VL2+100 V) and it is applied to a non-inverting input of an operational amplifier Q19 of the D.C. developing bias control circuit 20 (see FIG. 3) through a resistor R70 as a D.C. developing bias control voltage. Applied to an inverting input terminal of the operational amplifier Q19 is one fiftyth of the D.C. developing bias voltage derived by a resistor network comprising resistors R71–R74 through a resistor R27. The operational amplifier Q19 is a high gain differential amplifier. A closed loop is formed to maintain the potential at the junction of the resistors R71 and R72 to be equal to the D.C. developing bias control voltage so that the D.C. developing bias voltage follows the control voltage with a high precision.

The output of the operational amplifier Q19 is applied to a center tap of an inverter transformer T1 through a current booster comprising transistors Q20 and Q21. The D.C. developing bias voltage is produced by a combination of a variable output inverter having an oscillation output varied with the output of the operational amplifier Q19 and a fixed output inverter comprising a transformer T2.

The variable output inverter is an self-excited oscillating inverter comprising transistors Q22 and Q23. The transistors Q22 and Q23 are alternately turned on and off so that the voltage induced in the primary widing is stepped up to a secondary voltage which is determined by a turn ratio of the inverter transformer T1 in accordance with the D.C. developing bias control voltage applied to the center tap of the inverter transformer T1. The resulting secondary voltage is half-wave rectified by a diode D30 and smoothened by a capacitor C38, and the resulting voltage is applied to the A.C. developing bias control circuit 23 of FIG. 1 from the pin 1 of the connector J5 through a resistor R28, as the D.C. developing bias. The fixed output inverter is applied with a constant voltage of 24 V at a center tap of a primary winding of the transformer T2 and produces a secondary high voltage in accordance with a turn ratio of the transformer T2. This voltage is rectified and filtered by a diode D31 and a capacitor C41 to produce a negative D.C. high voltage of −600 V, for example. This voltage is divided by resistors R30–R35 and a divided voltage is superimposed on the output of the variable output inverter as the negative D.C. bias so that the D.C. developing bias voltage linearly changes from a positive potential to a negative potential depending on the control voltage. The fixed output inverter also produces a −5 V voltage used in the potential control circuit, a 24 V voltage for the surface potential measurement circuit, a 40 V floating voltage and a −600 V high voltage by the same transformer.

The high voltage control for the chargers 2 and 3 is now explained. The primary high voltage control voltage is applied to the inverting input of the operational amplifier Q16 through a resistor R40. A voltage derived by level-shifting the primary high voltage output pulse, produced by sampling the primary high voltage by a resistor R51, by resistors R41, R42 and VR3 is applied to the non-inverting input of the operational amplifier Q16 through a resistor R41. A differential voltage of those input voltages is magnified by a factor of −R44/R40 in the operational amplifier Q16. The output voltage therefrom is current-amplified by a transistor Q24 through a resistor R45 to produce the primary high voltage, which is applied to a control input of a primary high voltage transformer 21 through a terminal 2 of a connector J6. When the signal HV-1 applied to the connector J1 through the terminal P101 is "H", the LED-4 is not lit and a diode D10 is reverse-biased and a diode D11 conducts and a transistor Q36 conducts. As a result, the primary high voltage transformer 21 is not activated. When the signal HV-1 is "L", the LED-4 is lit and the diode D10 is forward biased and the diode D11 is cut off and the transistor Q36 is cut off. Accordingly, the output of the operational amplifier Q16 is applied to a base of a transistor Q24 so that the primary high voltage transformer 21 is activated to enable the control of the primary high voltage transformer.

If the current flowing into the resistor RS1 decreases by a change in the high voltage load, a voltage drop across the resistor RS1 is reduced and the voltage at a center tap of the potentiometer VR3 rises. As a result, the output of the operational amplifier Q16 rises to increase the output of the high voltage transformer so that the current flowing into the resistor RS1 is increased. In this manner, the constant current high voltage control is attained in accordance with the voltage drop across the resistor R40. Similar arrangements are used to control the high voltages for the secondary charger 3, the transfer charger 28 and the predischarger 29. When a feedback loop from the primary high voltage transformer is opened, the output of the operational amplifier Q16 reaches a maximum value so that the primary high voltage reaches a maximum value. Accordingly, the diode D12 is rendered conductive when the loop is opened to turn on the transistor Q36 in order to prevent the high voltage output.

FIGS. 6-1 ~ 6-3 show other embodiments of the present invention, in which the like elements to those shown in FIG. 1 are designated by the like numerals and they are not explained here.

In the embodiment shown in FIG. 6-1, the open state of the feedback loop is detected by a level shift circuit 50. An anode of a detecting diode D'3 is connected to a potentiometer VR3 of the level shift circuit 50 through a zener diode ZD1 and a cathode thereof is connected to a base of a transistor Q36. By selecting a zener voltage of the zener diode ZD1 such that a diode D3 is rendered nonconductive in a normal state and rendered conductive when the loop is opened, the same operation as that in FIG. 1 is carried out and the same effect is attained.

In the embodiment of FIG. 6-2, a light emitting diode LED 10 is connected between a base of a transistor Q24 and a collector of a transistor Q36. When the feedback loop is opened and an abnormal state occurs, the transistor Q36 is turned on to cause the LED to emit light so that the abnormal state is visually indicated.

In the embodiment of FIG. 6-3, a voice synthesizer circuit 100 is connected to the collector of the transistor Q36 through a triggering diode D40 so that the voice synthesizer circuit 100 is driven when the abnormal state occurs to issue an alarm from a speaker 111.

In this manner, the open state of the loop of the closed loop constant current high voltage corona generating circuit is detected by means of diode or the like to prevent the high voltage control input so that the generation of the abnormal high voltage is prevented and the abnormal state is informed.

The control of the secondary charger is now explained. The secondary charge high voltage control voltage is applied to a non-inverting input of an operational amplifier Q18 through a resistor R46. Applied to an inverting input is a voltage derived by level-shifting a secondary high voltage sampled voltage, produced by sampling the secondary high voltage by a resistor R52, by resistors R47, R48 and VR4, through a resistor R49. A differential voltage between those input voltages is magnified by a factor of R50/R49 in the operational amplifier Q18. The output voltage therefrom is current-amplified by a transistor Q25 through a resistor R51 to produce the secondary high voltage control voltage, which is applied to a control input of the secondary high voltage transformer 22 through a terminal 4. When the signal HV-2 applied to the connector J1 is "H", the LED-5 is not lit and a diode D9 is reverse biased and an inverter Q26 is turned on. As a result, the output of the operational amplifier Q18 is not conveyed to the high voltage transformer and the high voltage transformer is not activated. When the signal HV-2 is "L", the LED-5 is lit and the diode D9 is forward biased and the inverter Q26 is turned off. As a result, the output of the operational amplifier is supplied to the base of the transistor Q25 so that the secondary high voltage transformer 22 is activated to allow the control of the secondary high voltage transformer.

Regarding the transfer high voltage control, since the terminal P08 of the D/A converter Q1 is set to be "H" in the equi-scale copy mode, an output of an inverter Q28 is "L" and a voltage derived by dividing the voltage of 12 V by parallel resistance of resistors R52 and R53 and a resistor R54 is applied to an inverting input of an operational amplifier Q29 through a resistor R55. Applied to a non-inverting input thereof is a voltage derived by level-shifting a voltage, produced by sampling a transfer current by a resistor R53, by resistors R56 and R57 through a resistor R58. The output of the operational amplifier Q29 is set such that both inputs are equal. A transfer high voltage transformer 26 is driven by a transistor Q30 through the terminal 6 of the connector J6 to control the transfer high voltage. In the reduced scale copy mode, the terminal P08 is switched to "L" and the inverter Q28 is turned off so that the voltage derived by dividing the voltage of 12 V by the resistors R54 and R53 is supplied to the inverting input of the operational amplifier Q29 through the resistor R55. Since this voltage is larger than that in the equi-scale copy mode by the amount corresponding to a ratio of the transfer currents flowing in the resistor R53 in the equi-scale copy mode and the reduced scale copy mode, the output of the operational amplifier Q29 is reduced so that the transfer high voltage control is effected to cause a predetermined transfer current in the reduced scale copy mode to flow in the resistor R53.

Regarding the predischarge high voltage control, since the terminal P08 of the D/A converter Q1 is "H" in the equi-scale copy mode, an output of an inverter Q31 is "L" through the terminal P104 and an output of an inverter Q32 is "H". As a result, a voltage derived by dividing the voltage of 18 V by resistors R60 and R61 is applied to a non-inverting input of an operational amplifier Q33 through a resistor R62. Applied to an inverting input thereof is a voltage derived by level-shifting a voltage, produced by sampling the predischarge current by a resistor RS4, by resistors R63 and R64, through a resistor R65. The output of the operational amplifier Q33 is set such that the input voltages are equal. A transistor Q34 is driven through a resistor R66 to control the predischarge high voltage.

In the reduced scale copy mode, the terminal P08 is switched to "L" so that the output of the inverter Q31 assumes "H" and the inverter Q32 is turned on. As a result, a voltage derived by dividing the voltage of 18 V by a parallel resistance of the resistors R67 and R62 and the resistor R66 is applied to the non-inverting input of the operational amplifier Q33 through the resistor R62. Since this voltage is smaller than that in the equi-scale copy mode by the amount corresponding to a ratio of the transfer currents flowing in the resistor RS4 in the equi-scale copy mode and the reduced scale copy mode, the output of the operational amplifier Q33 is reduced so that the predischarge high voltage control is effected to cause a predetermined predischarge current in the reduced scale copy mode to flow in the resistor RS4.

The transfer high voltage and the predischarge high voltage are turned on and off in synchronism with the turn-on and the turn-off of the primary high voltage. When the signal HV-1 applied to the pin 5 of the connector J1 is "H", the diode D16 is reverse biased through the terminal P101 and the diode D17 is turned on and the transistor Q35 is also turned on. As a result, diodes D20 and D21 are forward biased to clamp the bases of the transistors Q30 and Q34 to approximately 0.7 volt, respectively. As a result, the control voltage is not conveyed to the high voltage transformer and the transfer and predischarge high voltages are turned off. When the signal HV-1 is "L", the diode D16 is forward biased and the diode D17 is turned off and the transistor Q35 is also turned off. As a result, the transistors Q30 and Q34 are driven by the outputs of the operational amplifiers Q29 and Q33 so that the transfer and predischarge high voltages are turned on. For the purpose of protection against the open state of the feedback loop, the transistor Q35 in the feedback loop from the transfer high voltage transformer can be turned on and off through the diode D18. When the loop is opened, the diode D18 is turned on to turn on the transistor Q35 so that the high voltage output is turned off to prevent the generation of abnormal high voltage.

Referring now to FIG. 4, a potential control sequence is explained.

In a step 1 (S1) in FIG. 4 (A), after the start (50), a RAM area is cleared by a reset signal (RESET) from the sequence controller (51) and then primary high voltage control data (PC CONTROL VALUE; PCV), primary high voltage standard data (PC STANDARD VALUE; PSV), secondary high voltage control data (SC CONTROL VALUE; SCV), secondary high voltage standard data (SC STANDARD VALUE; SSV), weak secondary high voltage data (SC LSTR VALUE; SLV), primary and secondary corresponding data in the reduced scale copy mode, exposure quantity control data (HL CONTROL VALUE; HCV), exposure quantity standard data (HL STANDARD VALUE; HSV), developing bias control data (DB CONTROL VALUE; DCV), developing bias standard data (DB STANDARD VALUE; DSV), developing bias maximum value data (FDB VALUE; FDV), various data required for internal operations and initial values for flags are loaded to the RAM (52). Then, the ports are cleared (53) and the LED's connected to the ports are turned off. The output ports of the D/A converters are initialized (54).

In the following step 2 (S2), the rotation is checked by a flag (55). If it is a post-rotation, SLV is issued and a step 3 is carried out (56). If it is not the post-rotation, the primary and secondary high voltages are generated. The presence or absence of the charge control (CCC) is checked. If it is present, PCV and SCV are issued (57) and if it is absent, PSV and SSV are issued (58). (PCV and SCV are retained in a predetermined RAM area in a data determination routine to be described later.)

The data output routines for PCV, SCV, PSV, SSV and SLV, include reduced scale flag check routines. If the reduced scale flag is set (the flags are set depending on the input data in a step 8 to be described later), the data in the reduced scale copy mode (which correspond to 0.7 time of the data in the equi-scale copy mode) processed and raved in a step 12 to be described later or initially loaded in the RAM) are outputted.

In a step 3 (S3), the presence or absence of exposure quantity control (HLC) is checked (58'). If it is present, HCV is issued (59), and if it is absent, HSV is issued (60). In a step 4 (S4), the presence or absence of the developing bias control (DBC) is checked (61). If it is absent, DSV is issued (62), and if it is present, FDV is issued (63, 64) if an FDV flag (which indicates the outputting of the maximum developing bias) is set (the flag is set or reset in the data determination routine to be described later in accordance with the data from the controller). If the flag is not set, a DB flag (which indicates the outputting of the predetermined developing bais) is checked (65), and if it is set, DCV is issued (66), and if it is not set, data corresponding to zero volt is issued (67).

In the following step 5 (S5), the reduced scale flag (which is set or reset in the data determination routine in accordance with the reduced scale instruction data from the controller) is checked (68), and if the equi-scale copy mode is instructed (the reduced scale flag is reset), the transfer and discharge control ports are set to the equi-scale copy mode (69). If the reduced scale copy mode is instructed, those ports are set to the reduced scale copy mode (70).

In a step 6 (S6), the presence or absence of the DMS mode (display mode) is checked, and if it is present a display routine (step 17) to be described later) is carried out (C), and if it is absent, a step 7 is carried out.

In the step 7 (S7), if the STROB signal from the controller is off, the step 2 (S2) is carried out (72, A) to repeat the step for outputting the data. If the STROB signal is on, the data determination and process routine in a step 8 is carried out (B).

In the step 8 (S8) shown in FIG. 4(B), the data (DB0 ~ DB3) from the sequence controller are read in (73) and they are checked (74) to determine if they are reduced scale data or not. If they are reduced scale data (mode X 0.7), the reduced scale flag and the FDB flag are set and the post-rotation flag is reset and a step 16 is carried out (75). If they are not reduced scale data, they are checked (76) to determine if they are equi-scale data or not. If they are equi-scale data (mode $\times 1$), the reduced scale flag and the post-rotation flag are reset (77) and the FDB flag is set and the step 16 is carried out. Following to the determination of the equi-scale data, the data are checked (78) to determine if they are post-rotation (LSTR) data or not, and if they are, the post-rotation (LSTR) flag is set and the step 16 is carried out (79).

In a step 9 (S9), if the data from the sequence controller is $V_{L2}$ TS (80), the A/D converter is activated to convert the $V_{L2}$ measured potential to a digital value and it is saved (81). Then $V_{L2}+100$ V is calculated as the developing bias control data and it is saved, and the step 16 is carried out (82).

In a step 10 (S10), if the data from the sequence controller is $V_{L1}$ TS, the A/D converter is activated (83) to convert the $V_{L1}$ measured potential to a digital value and it is saved (84).

The presence or absence of the exposure quantity control is then checked. If it is absent, the output data is not changed and the step 16 is carried out. If it is present, the exposure quantity control data $HCVn=1/20(VL1n-VL10)+HCVn-1$ (where the subscript n indicates n-th control and VL10 indicates a data value corresponding to a target white background potential) is calculated and the result is saved, and the step 16 is carried out (86).

In a step 11 (S11), if the data from the sequence controller is $V_{SL}$ TS (87), a STROBLED is lit to indicate the receipt of the strobe signal and the A/D converter is activated to convert the $V_{SL}$ measured potential to a digital value and it is saved (88). Then, the primary and secondary high voltage control data (PCV, SCV) which relate to $V_{SL}$ are processed, and the step 16 is carried out (89).

In a step 12 (S12), if the data from the sequence controller is $V_D$ TS (90), the STRBLED is turned off and the A/D converter is activated to convert the $V_D$ measured potential to a digital value and it is saved (91). The presence or absence of the charge control (CCC) is then checked (92), and if it is absent, the step 16 is carried out. If it is present, the control is calculated based on the bright and dark area potentials. If the contrast is lower than 500 V, the LED 2-3 is lit, and if the contrast is lower than 400 V, the LED 2-2 is lit. Then, PCV, SCV, PCV×0.7 and SCV×0.7 are calculated and the results are saved (93). If PCV or SCV reaches the upper limit, the LED 2-1 is lit. In this manner the control status is informed on real time.

By checking if the STRBLED (LED 2-4) is turned on and off in the predetermined sequence in the steps 11 and 12, the failure in the data lines can be easily detected.

In a step 13 (S13), if the data from the sequence controller is the developing bias ON (DBON) (94), the developing bias on flag (DB flag) is set and the FDB flag is reset, and the step 16 is carried out (95).

In a step 14 (S14), if the data from the sequence controller is the developing bias OFF (DB OFF) (96), the DB flag and the FDB flag are reset and the step 16 is carried out (97).

In a step 15 (S15), if the data from the sequence controller is the maximum developing bias ON (FDB ON) (98), the DB flag is reset and the FDB flag is set and the step 16 is carried out (99).

In the step 16 (S16), the process waits until the strobe signal from the sequence controller is turned off, when the process goes back to the output routine of the step 2 (100).

In a step 17 (S17), the process in the DMS mode starts. For the primary and secondary high voltages and the exposure quantity, the standard values (PSV, SSV, HSV) and the D.C. developing bias of zero volt are outputted (101).

In a step 18 (S18), display switching data is inputted (102). The presence or absence of the DMS mode is again checked (103), and if it is absent the indication of the LED is changed to that in the step 12 and the process goes back to the output routine of the step 2 (104).

In a step 19 (S19), if the potential display mode (MED) is present (105), the A/D converter is activated and the measured surface potential is displayed. Then the process goes back to the step 18 (106). If the MED is absent, the next step is carried out.

In a step 20 (S20), if the $V_D$ display mode is present (107), the $V_D$ data saved in the data determination routine is displayed and the process goes back to the step 18. If the $V_D$ mode is absent, the next step is carried out (108).

In a step 21 (S21), if the $V_{SL}$ display mode is present (109), the saved $V_{SL}$ data is displayed and the process goes back to the step 18. If the $V_{SL}$ display mode is absent, the next step is carried out (110).

In a step 22 (S22), if the $V_{L1}$ display mode is present (111), the saved $V_{L1}$ data is displayed and the process goes back to the step 18. If the $V_{L1}$ display mode is absent, the next step is carried out (112).

In a step 23 (S23), if the $V_{L2}$ display mode is present (113), the $V_{L2}$ data is displayed and the process goes back to the step 18 (115). If the $V_{L2}$ display mode is absent, the primary, secondary and control data are converted to four-bit data and they are displayed. Then the process goes back to step 18 (114).

The overall operation of the electrostatic recording apparatus which carries out the potential control described above is explained with reference to FIG. 5. After the power supply has been turned on, the photosensitive drum 1 rotates at a low speed, the high voltages are applied, and the photosensitive drum 1 starts to rotate at a high speed when a fixing roll (not shown) is heated to a predetermined temperature, and high voltages suitable to the high speed rotation are applied to the predischarger 29, the primary charger 2, the secondary charger 3 and the transfer charger 28 (prerotation).

If the optical system is not positioned at the equi-scale copy position, the optical system is moved to the equi-scale copy position simultaneously with the start of the prerotation. Then the potential control is carried out by the microcomputer 15. In the potential control process, the high voltage charge quantity to the photosensitive drum 1, the light quantity of the exposure lamp 11 and the bias to the developing roll 5 are controlled to form an optimum quality of image. Upon the termination of the potential control, the wait status terminates and the copy operation is allowed.

Usually, the so-called post-rotation is carried out in which the photosensitive drum 1 is rotated to remove residual charges on the drum by the secondary charger to clean the surface of the drum. Thereafter, the drum is stopped and a standby status for the copy operation starts.

As described above, according to the present invention, the presence or absence of the charge control, exposure control and developing bias control (that is, whether the control values or predetermined standard values are to be outputted) are designated to the digital computer and the digital computer is controlled such that it produces the charge quantity, exposure quantity and the developing bias in accordance with the designation. Accordingly, even if an abnormal surface potential is measured, more or less normal image can be formed.

In the electrostatic recording apparatus of the present invention, the charge quantity, exposure quantity and developing bias can be independently determined. Accordingly, the failure in each of the charger, exposure lamp and the developer can be checked.

An embodiment in which the developing bias can be selected depending on the text is now explained with reference to FIGS. 7 ~ 10.

Figure 7:
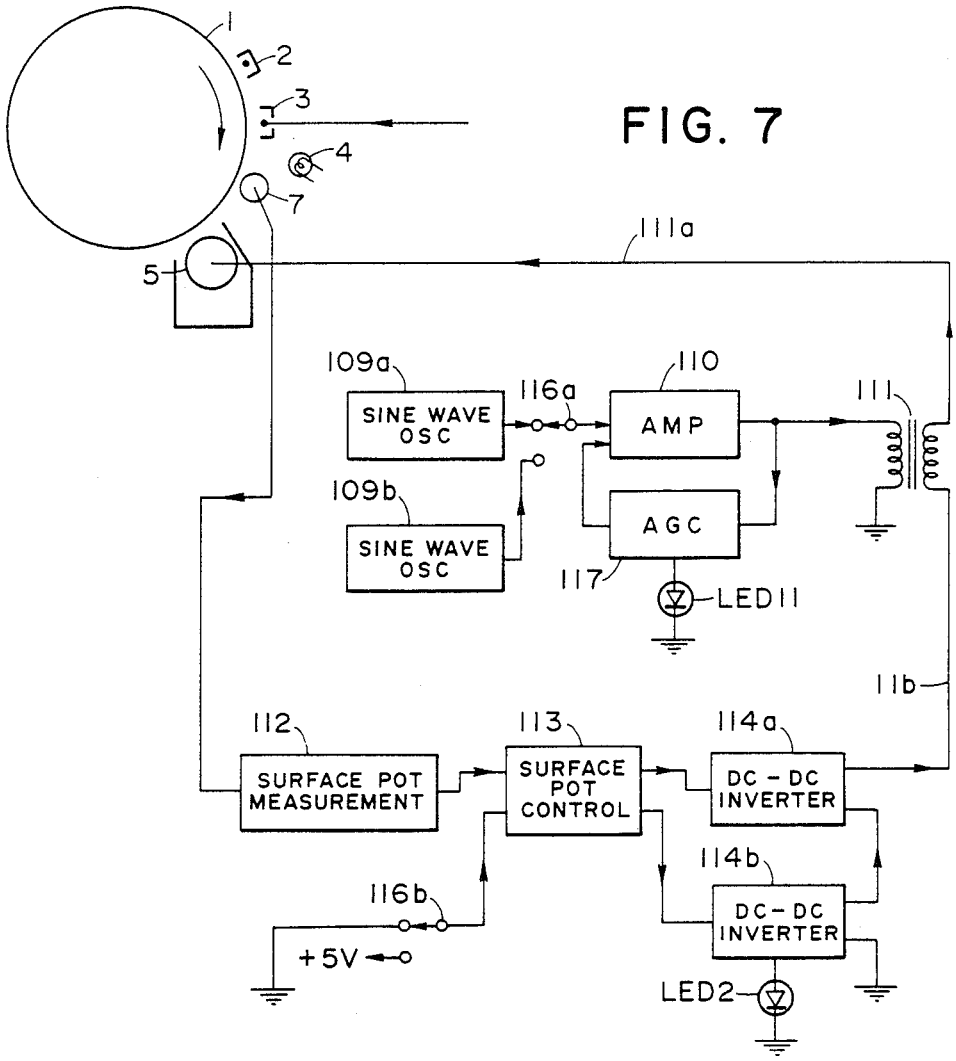
FIG. 7 shows a schematic configuration of another embodiment of the electrostatic recording apparatus.

In FIG. 7, the like numerals to those shown in FIG. 1 denote the like elements.

Applied to the developing roll 5 in a bias voltage through a line 111*a* to carry out the jumping development. The bias voltage consists of an A.C. bias voltage and a D.C. bias voltage. The A.C. bias voltage is generated by a sine wave oscillator 109*a* or 109*b*, an amplifier 110 and a step-up transformer 111. The sine wave oscillators 109*a* and 109*b* are selected by a switch 116*a* and the selected sine wave oscillator generates a sine wave of a predetermined frequency. The sine wave is amplified without distortion by the class A power amplifier 110 an output of which is stepped up by the step-up transformer 111, which has a step-up ratio of approximately 100 and steps up the input sine wave without saturation and distortion to approximately 500 ~ 2000

V p-p. The stepped-up A.C. bias voltage is applied to the developing roll 5 through the line 111*a*.

The output of the amplifier 110 is supplied to an automatic gain control (AGC) circuit 117 which compares the input voltage with a reference and feeds back an error voltage to a gain control input of the amplifier 110. An LED 111 connected to the AGC circuit 117 is turned on and off depending on the output magnitude of the amplifier 110. When the output is low, the LED 11 is turned off or darkened to inform an error in the circuit.

Connected to one terminal of the secondary winding of the step-up transformer 111 through a line 111*b* is an output terminal of a DC-DC inverter 114*a* which supplies a D.C. bias of −500 V ~ +500 V. A voltage from a surface potential control circuit 113 is applied to the DC-DC inverter 114*a*. The surface potential sensor 7 located in front of the developer measures a latent image potential on the photosensitive drum 1. The latent image potential $V_{SL}$ formed under a constant light quantity is detected by the surface potential sensor 7 and it is divided by a factor of 300 in a surface potential measurement circuit 112 an output of which is supplied to the surface potential control circuit 113. The control circuit 113 processes the input signal such that a D.C. voltage of ($V_{SL}$+100) volts, for example, is produced from the output of the DC-DC inverter 114*a*.

In addition to the DC-DC inverter 114*a*, another DC-DC inverter 114*b* is provided, which is also controlled by the surface potential control circuit 13. The DC-DC inverter 114*b* is driven by a switch 116*b* which is linked to the switch 116*a* so that when the sine wave oscillator 109*b* is selected a potential of +5 V is applied to the surface potential control circuit 113 which causes the DC-DC inverter 114*b* to produce a predetermined D.C. voltage (e.g. 50 V). Accordingly, the A.C. bias voltage produced by the sine wave oscillator 109*a* or 109*b* and the D.C. bias voltage produced by the DC-DC inverters 114*a* and 114*b* are applied, in superposition, to the developing roll 5.

Figure 8:
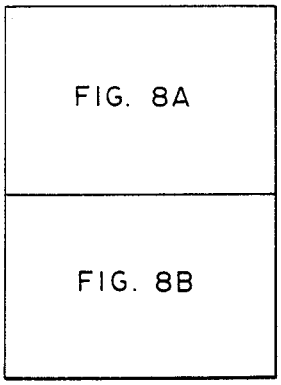
FIGS. 8A and 8B show in the combination a detailed circuit diagram of a portion of FIG. 7.
Figure 8A:
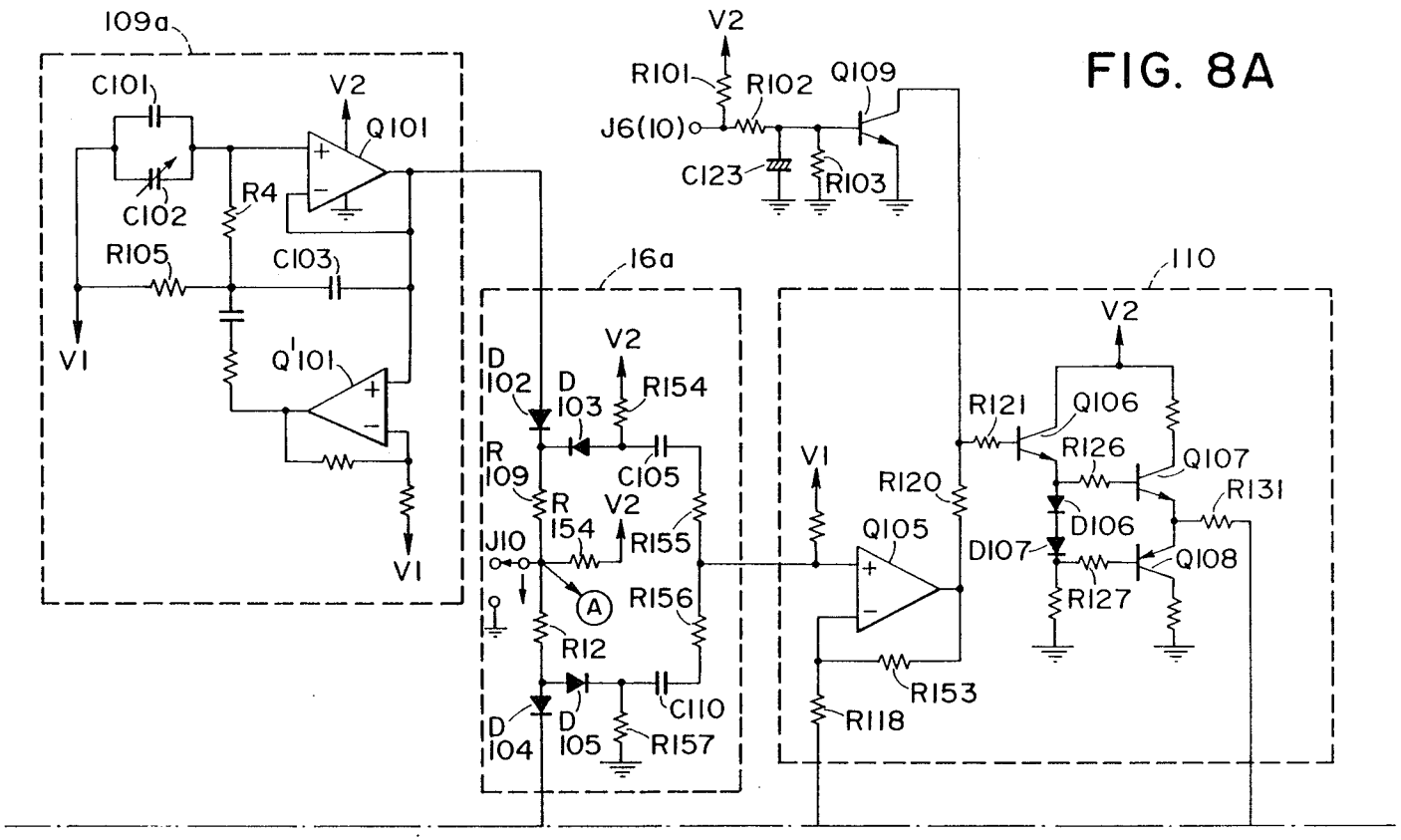
Figure 8B:
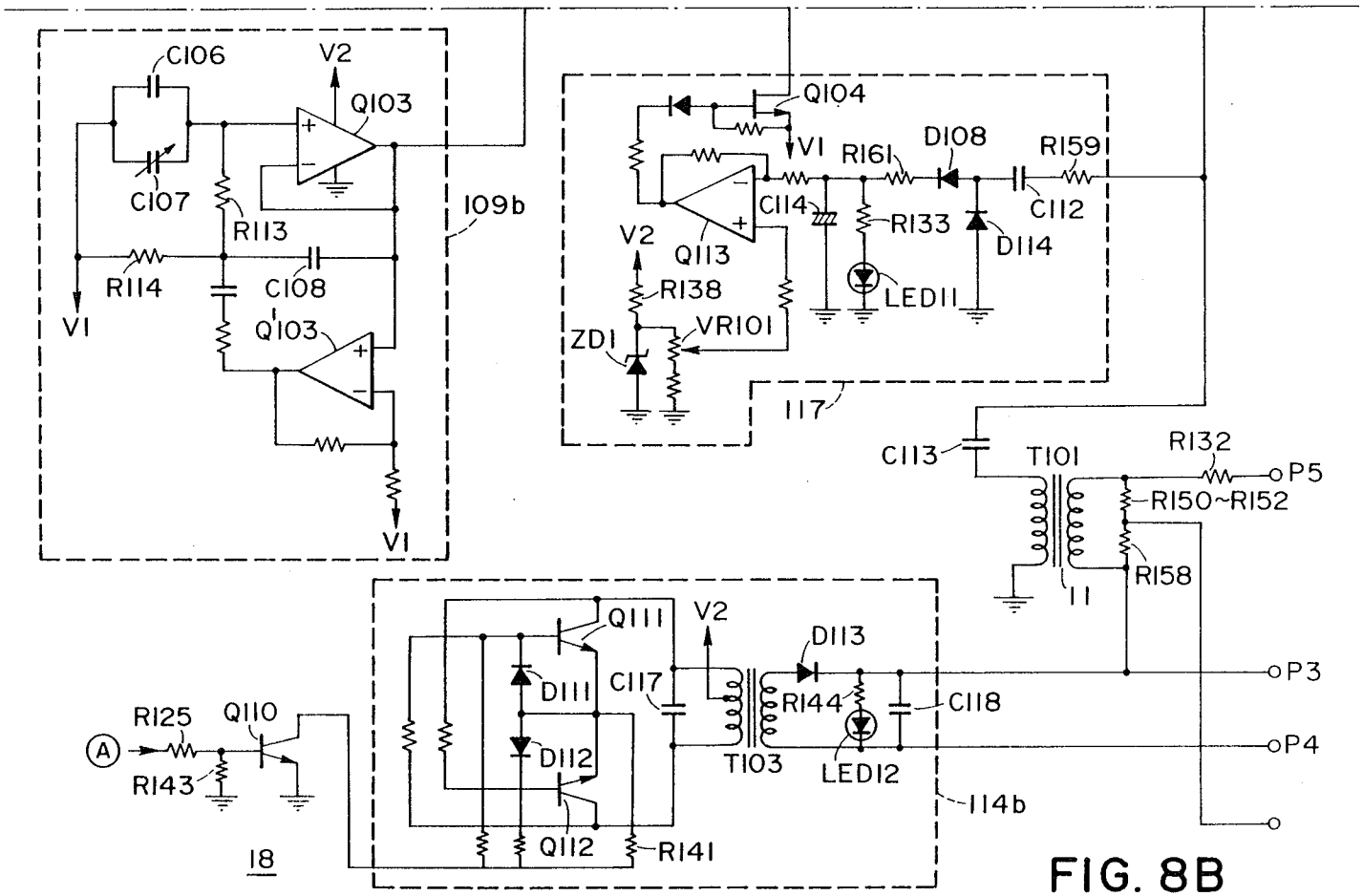

FIG. 8 shows specific circuits of the sine wave oscillators 109*a* and 109*b*, the amplifier 110, the AGC circuit 117 and the DC-DC inverter 114*b*. The sine wave oscillator 109*a* comprises a differential amplifier Q101, a capacitor C103 and resistors R104 and R105 which form a dummy inductance, an output of which is positively fed back through a differential amplifier Q'101. The oscillation frequency f1 is given by $$f1 = \tfrac{1}{2}\pi\sqrt{C'C3R'2}$$

where R'=R104=R105 and C' is a parallel capacitance of the capacitors C101 and C102.

The sine wave oscillator 109*b* is constructed similarly to the oscillator 109*a*. The sine wave oscillator 109*a* oscillates a sine wave of 800 ~ 1500 Hz by adjusting the capacitor C102 while the sine wave oscillator 109*b* oscillates a sine wave of 200 ~ 600 Hz by adjusting the capacitor C107. V1 and V2 denote power supply voltages.

The outputs of the sine wave oscillators 109*a* and 109*b* are supplied to a diode switch comprising diodes D102 ~ D105. When the switch 116*a* is thrown to the upper position in FIG. 1 and a switch terminal J10 is grounded, the diodes D102 and D103 conduct and the diodes D104 and D105 are cut off so that the output of the sine wave oscillator 109*a* is applied to the amplifier 110. On the other hand, when the switch 116*a* is thrown to the lower position and the switch terminal J10 is opened, the voltage of V2 (+24 V) is applied to the junction point of the diodes through a resistor R154 and the diodes D102 and D103 are cut off while the diodes D104 and D105 conduct so that the output of the sine wave oscillator 109*b* is applied to the amplifier 110.

The amplifier 110 comprises a differential amplifier Q105, an emitter follower transistor Q106 and final stage drivers Q107 and Q108. An amplification factor of the amplifier 110 is determined by a source-drain resistance of an FET Q104 of the AGC circuit 117 connected to a resistor R118. The output of the differential amplifier Q105 is connected to a base of the emitter follower Q106 and a collector of a transistor Q109 through a resistor R120. The transistor Q109 is a control switch for the A.C. developing bias voltage. When the port 10 of the connector J6 (J6 (10)) is opened, the voltage V2 is applied to the base of the transistor Q109 through a resistor R101 to conduct the transistor Q109. As a result, the output of the differential amplifier Q105 is zero volt at the junction of the resistors R120 and R121 and the A.C. bias is zero volt. When the terminal J6 (10) is grounded, the transistor Q109 is opened and the output of the differential amplifier Q105 is applied to the emitter follower Q106 so that the A.C. voltage of the predetermined frequency is produced at the emitters of the transistors Q107 and Q108.

A control signal is applied to the terminal J6 (10) from the sequence controller of the recording apparatus such that the terminal J6 (10) is opened to maintain the A.C. bias at zero except in the developing operation. A capacitor C123 connected between the base and the emitter of the transistor Q109 functions to smoothen the rise and the fall in the switching of the transistor Q109 and eliminate an overshoot ringing which occurs in the secondary winding of the step-up transformer when the transistor Q109 is turned on and off.

The output of the amplifier 110 is applied to the primary winding of the step-up transformer 111 through a resistor R131 and a capacitor C113. The step-up transformer 111 is a lamination type transformer of high saturation magnetic flux density silicon steel plates and has a step-up ratio of approximately 100 and a flat frequency characteristic in a frequency range of 200 ~ 1500 Hz. One end of the secondary winding of the step-up transformer 111 is connected to a positive output terminal of the DC-DC inverter 114*b*. A negative output terminal of the DC-DC inverter 114*b* is connected to the output of the DC-DC inverter 114*a* (not shown in FIG. 8), which output is maintained at the voltage of $V_{SL}$+100 V in the developing operation. When the switch terminal J10 is opened, the sine wave oscillator 109*b* is selected and a transistor Q110 of an electronic stitch 118 conducts (the junction of resistors R109 and R154 is connected to a base of a transistor Q110 through a resistor R125) so that a self-excited inverter comprising transistors Q111 and Q112, a capacitor C117 and a coil T103 starts to oscillate to produce a D.C. voltage of 50 V across terminals P3 and P4. When the switch terminal J1 is grounded, the transistor Q110 is cut off so that the power supply voltage is not supplied to the primary circuit of the DC-DC inverter 114*b* and the voltage between the terminals P3 and P4 becomes zero. A terminal P5 is connected to the developing sleeve 8. Resistors R150, R151, R152 and R158 have dual function of a bleeder resistor and the generation of a monitor voltage which is one hundredth of the A.C. output at the junction of the resistors R152 and R158.

The AGC circuit 117 rectifies the output of the amplifier 110 by a voltage doubler circuit including diodes D114 and D108 to produce a D.C. voltage. A differential amplifier Q113 compares this D.C. voltage with a reference voltage derived by dividing a voltage across a zener diode ZD101 by a potentiometer VR101 and amplifies an error voltage. The amplified error voltage is applied to a gate of an FET Q104 to change a drain-source resistance of the FET Q104 to control an open gain of the amplifier 110 such that the output of the amplifier 110 is kept constant. A portion of the rectified output is applied to a light emitting diode LED 1 through a resistor R133 to indicate whether the normal A.C. output is produced or not. A light emitting diode LED 2 is connected in series with a bleeder resistor R144 in the secondary circuit of the DC-DC inverter **114*b*** to indicate whether the inverter produces the normal voltage or not.

In the developing bias apparatus thus constructed, when the charging and the exposure are started in the predetermined sequence and latent image formed on the photosensitive drum 1 comes close to the developer 7, a control signal is produced by the sequence controller of the recording apparatus to ground the terminal J6 (10). As a result, the transistor Q109 is turned off and the A.C. bias voltage is produced at the junction of the resistors R121 and R120. When a text includes half tone images such as a photograph, the switch **116*a* is thrown to the lower position. Then, the terminal J10 is opened and the sine wave oscillator 109*b* of the lower frequency is selected and the A.C. bias voltage of 200 ~ 600 Hz is produced. For a text including few half tone image, the switch 116*a* is thrown to the upper position. Thus the terminal J10 is grounded and the sine wave osciallator 109*a* of the higher frequency is selected so that the A.C. bias voltage of 800 ~ 1500 Hz is produced. The A.C. bias voltage is amplified by the amplifier 110 and the amplified voltage is applied to the primary winding of the step-up transformer 111**, which produces the A.C. bias voltage stepped up by the factor of 100 at the secondary winding.

On the other hand, the DC-DC inverter **114*a* produces the D.C. bias voltage of $V_{SL}+100$ V. When the switch 116*a* is thrown to the lower position, the DC-DC inverter 114*b* is activated to produce the voltage of 50 V across the terminals P3 and P4. Accordingly, the D.C. bias voltage of $V_{SL}+150$ V is produced in the secondary winding of the step-up transformer 111**.

Figure 9:
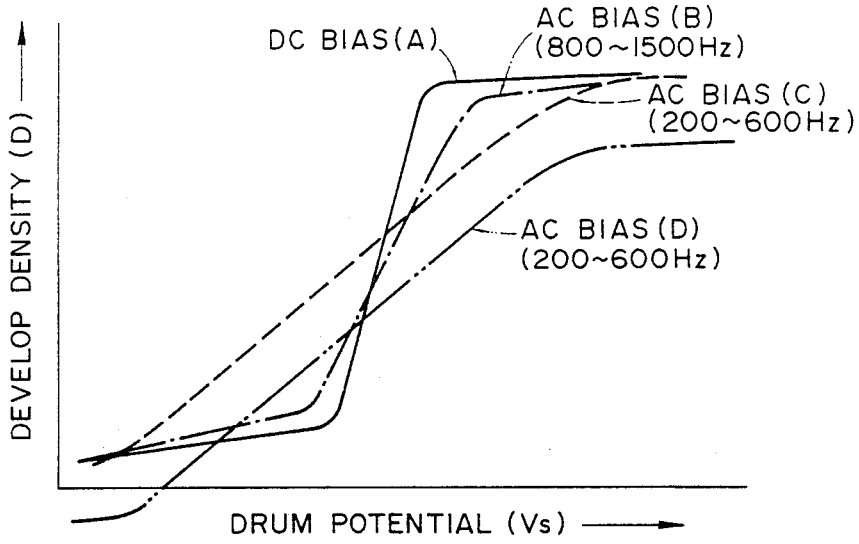
FIG. 9 shows characteristic curves illustrating relationship of density versus developing bias.

Accordingly, the A.C. bias voltage from the sine wave oscillator **109*a* or 109*b* and the D.C. bias voltage from the DC-DC inverter 114*a* or 114*b* are applied in superposition to the developing roll 5 to effect the jumping development. When the A.C. bias is not applied, a high contrast image is reproduced as shown in FIG. 9(A), and when the higher frequency A.C. bias is applied the tone is well reproduced as shown in FIG. 9(B), and when the lower frequency A.C. bias is applied the tone is further improved as shown in FIG. 9(C). When the D.C. bias is increased from 100 V to 150 V, the image is reproduced as shown in FIG. 9**(D) in which the development in the white background area and low density area in the text is suppressed so that well-toned fog free image is reproduced. Thus, it is preferable that for the text having half tone, the lower frequency A.C. bias voltage and the high D.C. bias voltage are applied, and for the text having few half tone, the lower frequency A.C. bias voltage and the low D.C. bias voltage are applied. For the sake of simplicity of the construction, the D.C. bias and the A.C. bias may be fixed.

The output of the amplifier 110 is supplied to the AGC circuit 117 for automatic gain control. Accordingly, irrespective of the variation and the fluctuation of the outputs of the oscillators **109*a* and 109*b*, a stable output is always produced. In addition to the output of the amplifier 110, the output of the step-up transformer 111** may be automatically gain-controlled.

The switches **116*a* and 116*b*** may be automatically operated, rather than manually, such that the text is previously automatically scanned prior to the ordinary copy operation to determine whether the text is a line copy or includes half tone to automatically determine the magnitude and the frequency of the bias voltage.

Three or more sine wave oscillators of different frequencies may be selectively used to provide the A.C. bias voltage or the DC-DC inverter may be level controlled either stepwise or continuously to vary the D.C. bias voltage.

Figure 10:
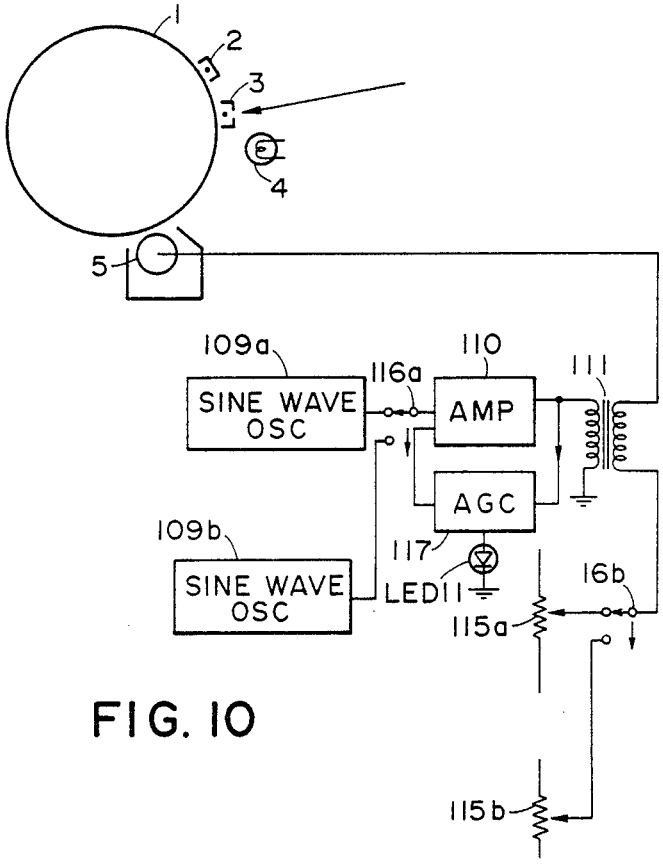
FIG. 10 shows a schematic configuration of another embodiment of FIG. 7, and FIGS. 11 and 12 show characteristics illustrating relationships between surface potential and exposure quantity.
Figure 11:
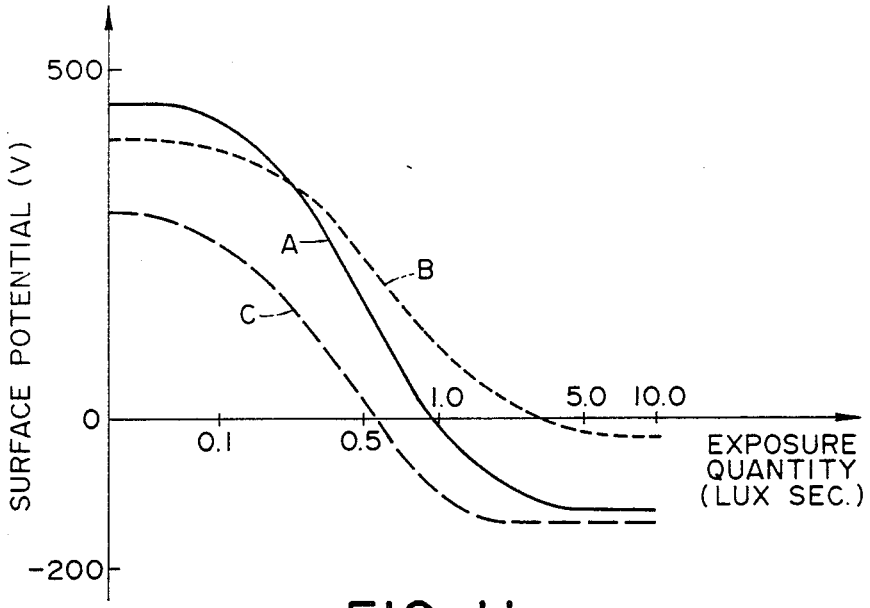
Figure 12:
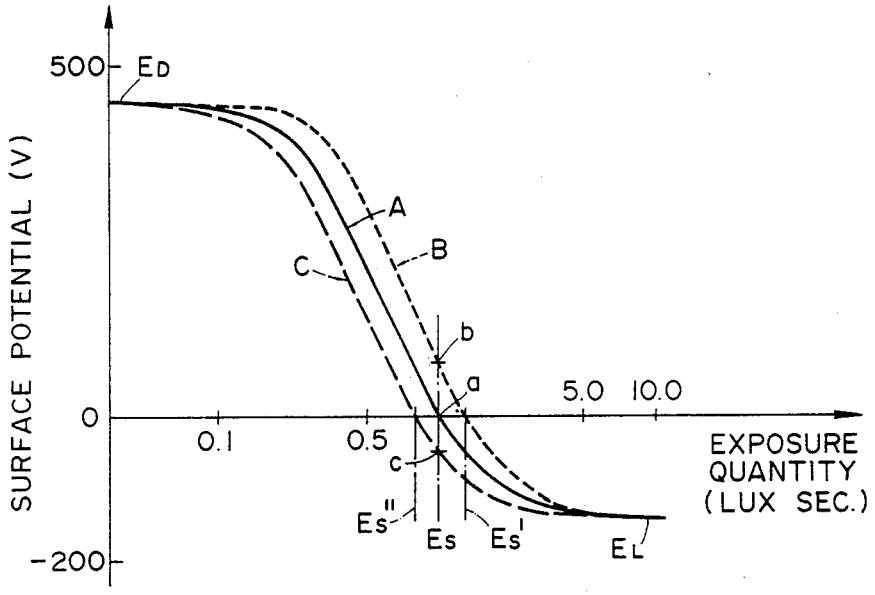

FIG. 10 shows an embodiment in which no surface potential sensor is used. The like elements to those shown in FIG. 7 are designated by the like numerals and they are not explained here. In the present embodiment, appropriate fixed bias sources **115*a* and 115*b* are connected to the terminal of the secondary winding of the step-up transformer 111 and they are selected by the switch 116*b*. By selecting the fixed bias source 115*a* to be lower than the fixed bias source 115*b*, the same effect as that in FIG. 7** is attained.

As discussed in detail hereinabove, the present apparatus offers the following advantages:

(1) Unlike the prior art apparatus, the sine wave is not produced by extracting only the reference frequency from the square wave generated by the LC circuit. Accordingly, no resonance loss is included, a power consumption is low and no electromagnetic noise is generated.

(2) The frequency can be readily switched. In the prior art apparatus it is necessary to change a large capacity C or L which is designed to resonate with the frequency of the square wave oscillator. In the present invention, only the frequency of the sine wave oscillator need be changed and it is readily attained by a potentiometer or a variable capacitor.

(3) Adjustment of the resonance circuit is not required.

(4) By charging the D.C. bias superimposed on the A.C. bias depending on the latent image potential, a highly toned and fog free image is reproduced.

(5) When a plurality of sine wave oscillators of different frequencies are selectively activated, the amplitude of the oscillator need not be adjusted and a stable output amplitude is always assured.

(6) Abnormal/normal states of the D.C. and A.C. developing bias voltages can be simply and positively indicated.

What we claim is:

1. An image forming apparatus comprising:

exposure means for exposing an image onto a recording medium;

image forming means utilizing said exposed image for forming an image on said recording medium; and control means for detecting an image forming condition corresponsing to reflected light from a sample member and for controlling an operation condition of said exposure means based on the detected condition, wherein said control means further controls an operation condition of said image forming means in accordance with magnification of the image formation.

2. An image forming apparatus according to claim 1 wherein said sample member is illuminated by said exposure means.

3. An image forming apparatus according to claim 1 or 2 wherein said image forming means includes means for charging said recording medium, and wherein an operation condition of said charging means is controlled in accordance with said magnification of the image formation.

4. An image forming apparatus according to claim 1 or 2 wherein said image forming condition is a surface condition on said recording medium.

5. An image forming apparatus according to claim 4 wherein said surface condition is a surface potential.

6. An image forming apparatus according to claim 1 wherein said sample member has a predetermined density which is a standard white density.

7. An image forming apparatus comprising:

image forming means for forming an image on a recording medium, said image forming means including exposure means for exposing said recording medium; and control means for detecting an image forming condition of said image forming means including an exposure condition and for controlling an operation condition of said exposure means based on the detected condition, wherein said control means corrects data corresponding to the control of the operation condition of said image forming means in accordance with magnification of the image formation.

8. An image forming apparatus according to claim 7 wherein said image forming means includes means for charging said recording medium, and said control means corrects the data involved in the control of the operation condition of said charging means in accordance with the magnification of the image formation.

9. An image forming apparatus according to claim 7 wherein said control means performs a regulating control of the operation condition of said image forming means in response to detection of the image forming condition.

10. An image forming apparatus according to claim 9 wherein said control means causes a light from said exposure means to be projected to a predetermined sample member, and detects the exposure condition in accordance with the quantity of the reflection light from said sample member.

11. An image forming apparatus according to claim 10 wherein said control means detects the exposure condition based on the surface condition produced on said recording in accordance with the quantity of the reflection light from said sample member.

* * * * *

UNITED STATES PATENT AND TRADEMARK OFFICE

CERTIFICATE OF CORRECTION

PATENT NO. : 4,511,240

DATED : April 16, 1985

INVENTOR(S) : KOJI SUZUKI, ET AL.

It is certified that error appears in the above-identified patent and that said Letters Patent is hereby corrected as shown below:

Column 2, line 24, change "an" to --a--.

Column 3, line 33 and 36, change "a" to --a--(first occurence).

Column 4, line 16, change "tarnsformer" to --transformer--.

Column 4, line 29, change "is" to --in--.

Column 5, line 3, insert --The-- before "above";
line 36, change "to" to --by--.

Column 6, line 34, change "corelation" to --correlation--;
line 56, change "converged" to --converted--.

Column 8, line 60, change "dependin" to --depending--.

Column 9, line 38, change "off Since" to --off. Since--;
line 65, change "process" to --processes--.

Column 11, line 26, change "complement" to --complementary--;
line 64, delete "to a".

Column 13, lines 56 and 62, change "fifyth" to --fiftieth--.

Column 14, line 11, delete "an";
line 14, change "widing" to --winding--

Column 17, line 65, change "raved" to --saved--.

Column 18, line 11, change "bais" to --bias--;
line 25, change "17)" to --17,--.

Column 20, line 65, change "110" to --110,--.

Column 23, line 35, change "image," to --images,--.

UNITED STATES PATENT AND TRADEMARK OFFICE

CERTIFICATE OF CORRECTION

PATENT NO. : 4,511,240

DATED : April 16, 1985

INVENTOR(S) : KOJI SUZUKI, ET AL.

It is certified that error appears in the above-identified patent and that said Letters Patent is hereby corrected as shown below:

Column 24,
line 4, change "of the" to --of--;
line 39, delete "a".

Signed and Sealed this

*Eighth* Day of *April 1986*

[SEAL]

*Attest:*

DONALD J. QUIGG

*Attesting Officer*

*Commissioner of Patents and Trademarks*